US009989046B2

(12) United States Patent
Cai et al.

(10) Patent No.: US 9,989,046 B2
(45) **Date of Patent: *Jun. 5, 2018**

(54) ROUNDEL STRUCTURE FOR FIVE-COMPRESSING-CHAMBER DIAPHRAGM PUMP

(71) Applicants: Ying Lin Cai, Foshan (CN); Chao Fou Hsu, Kaohsiung (TW)

(72) Inventors: Ying Lin Cai, Foshan (CN); Chao Fou Hsu, Kaohsiung (TW)

( * ) Notice: Subject to any disclaimer, the term of this patent is extended or adjusted under 35 U.S.C. 154(b) by 369 days.

This patent is subject to a terminal disclaimer.

(21) Appl. No.: 14/712,142

(22) Filed: May 14, 2015

(65) Prior Publication Data

US 2015/0337819 A1 Nov. 26, 2015

Related U.S. Application Data

(60) Provisional application No. 62/000,592, filed on May 20, 2014.

(51) Int. Cl.

| | |
|---|---|
| ***F04B 43/00*** | (2006.01) |
| ***F04B 53/14*** | (2006.01) |
| ***F04B 43/02*** | (2006.01) |
| ***F04B 1/12*** | (2006.01) |
| ***F04B 43/04*** | (2006.01) |
| ***F04B 45/047*** | (2006.01) |
| ***F04B 45/04*** | (2006.01) |
| *F04B 53/12* | (2006.01) |
| *F04B 53/10* | (2006.01) |

(52) U.S. Cl.

CPC ..... *F04B 43/0045* (2013.01); *F04B 1/12* (2013.01); *F04B 43/0054* (2013.01); *F04B 43/0063* (2013.01); *F04B 43/021* (2013.01); *F04B 43/025* (2013.01); *F04B 43/026* (2013.01); *F04B 43/04* (2013.01); *F04B 45/045* (2013.01); *F04B 45/047* (2013.01); *F04B 53/14* (2013.01); *F04B 53/10* (2013.01); *F04B 53/12* (2013.01)

(58) Field of Classification Search

CPC ..... F04B 1/12; F04B 43/0045; F04B 43/026; F04B 43/043; F04B 45/043; F04B 43/0054; F04B 43/0063; F04B 43/025; F04B 43/04

USPC ..... 417/413.1

See application file for complete search history.

(56) References Cited

U.S. PATENT DOCUMENTS 2,236,244 A * 3/1941 Cornelius ..... F04B 35/04 417/372
2,748,606 A * 6/1956 Cornelius ..... F04B 9/045 417/413.1
2,859,701 A * 11/1958 Williams ..... F04B 43/0045 417/568

(Continued)

*Primary Examiner* — Devon Kramer
*Assistant Examiner* — Christopher Bobish
(74) *Attorney, Agent, or Firm* — Bacon & Thomas, PLLC

(57) ABSTRACT

A roundel structure for a five-compressing-chamber diaphragm pump includes a cylindrical or inverted frustoconical eccentric roundel in an eccentric roundel mount. The cylindrical or inverted frustoconical eccentric roundel includes an annular positioning groove or indentation, a vertical or inverted frustoconical flank and a sloped top ring extending from the annular positioning groove or indentation to the flank. The sloped top ring eliminates the oblique high frequency pull and squeezing phenomena that occurs in a conventional tubular eccentric roundel arrangement.

2 Claims, 27 Drawing Sheets

(56) References Cited

U.S. PATENT DOCUMENTS 3,468,261 A * 9/1969 Schmierer ..... F04B 43/02 417/567
4,515,531 A * 5/1985 Roser ..... F04B 43/02 417/269
4,569,378 A * 2/1986 Bergandy ..... B65B 3/32 141/129
4,610,605 A * 9/1986 Hartley ..... F04B 43/0054 417/269
5,044,891 A * 9/1991 Ozawa ..... F04B 43/026 417/214
5,503,538 A * 4/1996 Wiernicki ..... A61M 5/14216 417/413.1
5,571,000 A * 11/1996 Zimmermann ..... F04B 43/026 137/510
5,626,464 A * 5/1997 Schoenmeyr ..... F04B 43/0054 417/269
5,649,812 A * 7/1997 Schoenmeyr ..... F04B 43/0054 248/628
6,089,838 A * 7/2000 Schoenmeyr ..... F04B 43/0054 310/88
6,343,539 B1 * 2/2002 Du ..... F04B 43/0054 92/100
6,840,745 B1 * 1/2005 Macauley ..... F04B 43/026 137/512.15
8,393,878 B2 * 3/2013 Cai ..... F04B 43/026 417/269
8,449,267 B2 * 5/2013 Pascual ..... F04B 43/0054 417/269
9,488,166 B2 * 11/2016 Ishii ..... F04B 43/04
2003/0209138 A1 * 11/2003 Schoenmeyr ..... F04B 43/026 92/48
2010/0068082 A1 * 3/2010 Cai ..... F04B 43/04 417/413.1
2010/0129234 A1 * 5/2010 Cai ..... F04B 43/02 417/312
2015/0337826 A1 * 11/2015 Cai ..... F04B 45/027 417/472
2016/0108902 A1 * 4/2016 Cai ..... F04B 43/0045 417/273
2016/0108903 A1 * 4/2016 Cai ..... F04B 43/02 417/273

* cited by examiner

ROUNDEL STRUCTURE FOR FIVE-COMPRESSING-CHAMBER DIAPHRAGM PUMP

This application claims the benefit of provisional U.S. Patent Application No. 62/000,592, filed May 20, 2014, and incorporated herein by reference.

FIELD OF THE PRESENT INVENTION

The present invention relates to a roundel structure for five-compressing-chamber diaphragm pump used in a RO (reverse osmosis) purification system, which is popularly installed on the commercial water supplying apparatus in either the settled home, recreational vehicle or mobile home of large scale, particularly for one with a sloped top ring that can eliminate the oblique pull and squeezing phenomena of the pump so that the service lifespan of the five-compressing-chamber diaphragm pump and the durability of key component therein are prolonged.

BACKGROUND OF THE INVENTION

Currently, the conventional five-compressing-chamber diaphragm pumps exclusively used with RO (Reverse Osmosis) purifier or RO water purification system, which is popularly installed on the water supplying apparatus in either the settled home, recreational vehicle or mobile home, have some various types. For five-compressing-chamber diaphragm pumps, other than the specific type as disclosed in the U.S. Pat. No. 8,449,267, the majority of conventional five-compressing-chamber diaphragm pumps can be categorized as similar design as shown in FIGS. 1 through 10. The conventional five-compressing-chamber diaphragm pump aforesaid essentially comprises a motor 10 with an output shaft 11, a motor upper chassis 30, a wobble plate with integral protruding cam-lobed shaft 40, an eccentric roundel mount 50, a pump head body 60, a diaphragm membrane 70, five pumping pistons 80, a piston valvular assembly 90 and a pump head cover 20, wherein said motor upper chassis 30 includes a bearing 31 to be run through by the output shaft 11 of the motor 10, an upper annular rib ring 32 with several fastening bores 33 disposed therein in circumferential rim evenly; said wobble plate with integral protruding cam-lobed shaft 40 includes a shaft coupling hole 41 for being run through by the corresponding motor output shaft 11 of the motor 10; said eccentric roundel mount 50 includes a central bearing 51 at the bottom thereof for corresponding wobble plate with integral protruding cam-lobed shaft 40, five tubular eccentric roundels 52 disposed thereon in circumferential location evenly such that each tubular eccentric roundel 52 has a horizontal top face 53, a female-threaded bore 54 and an annular positioning dent 55 formed on the top face thereof respectively in horizontal flush, as well as a rounded shoulder 57 created at the joint of the horizontal top face 53 and a vertical flank 56; said pump head body 60, which covers on the upper annular rib ring 32 of the motor upper chassis 30 to encompass the wobble plate with integral protruding cam-lobed shaft 40 and eccentric roundel mount 50 therein, includes five operating holes 61 disposed therein in circumferential location evenly such that each operating hole 61 has inner diameter slightly bigger than outer diameter of the tubular eccentric roundel 52 in the eccentric roundel mount 50 for receiving each corresponding tubular eccentric roundel 52 respectively, a lower annular flange 62 formed thereunder for mating with corresponding upper annular rib ring 32 of the motor upper chassis 30, several fastening bores 63 disposed thereat in circumferential location evenly; said diaphragm membrane 70, which is extrude-molded by semi-rigid elastic material and to be placed on the pump head body 60, includes a pair of parallel outer raised brim 71 and inner raised brim 72 as well as five evenly spaced radial raised partition ribs 73 such that each end of radial raised partition rib 73 connects with the inner raised brim 72, five equivalent piston acting zones 74 are formed and partitioned by the radial raised partition ribs 73, wherein each piston acting zone 74 has an acting zone hole 75 created therein in correspondence with each female-threaded bore 54 in the tubular eccentric roundel 52 of the eccentric roundel mount 50 respectively, and an annular positioning protrusion 76 for each acting zone hole 75 is formed at the bottom side of the diaphragm membrane 70 (as shown in FIGS. 8 and 9); each said pumping piston 80, which is respectively disposed in each corresponding piston acting zones 74 of the diaphragm membrane 70, has a tiered hole 81 run through thereof, after having each annular positioning protrusion 76 in the diaphragm membrane 70 inserted into each corresponding annular positioning dent 55 in the tubular eccentric roundel 52 of the eccentric roundel mount 50, by running fastening screw 1 through the tiered hole 81 of each pumping piston 80 and the acting zone hole 75 of each corresponding piston acting zone 74 in the diaphragm membrane 70, the diaphragm membrane 70 and five pumping pistons 80 can be securely screwed into each female-threaded bore 54 of corresponding five tubular eccentric roundels 52 in the eccentric roundel mount 50 (as enlarged view shown in FIG. 10 of association); said piston valvular assembly 90, which suitably covers on the diaphragm membrane 70, includes a downward outlet raised brim 91 to insert between the outer raised brim 71 and inner raised brim 72 in the diaphragm membrane 70, a central dish-shaped round outlet mount 92 having a central positioning bore 93 with five equivalent sectors each of which contains multiple evenly circum-located outlet ports 95, a T-shaped plastic anti-backflow valve 94 with a central positioning shank, and five circumjacent inlet mounts 96, each of which includes multiple evenly circum-located inlet ports 97 and a inverted central piston disk 98 respectively so that each piston disk 98 serves as a valve for each corresponding group of multiple inlet ports 97, wherein the central positioning shank of the plastic anti-backflow valve 94 mates with the central positioning bore 93 of the central outlet mount 92 such that multiple outlet ports 95 in the central round outlet mount 92 are communicable with five inlet mounts 96, and a hermetical preliminary-compressing chamber 26 is formed between each inlet mount 96 and corresponding piston acting zone 74 in the diaphragm membrane 70 upon the downward outlet raised brim 91 having inserted between the outer raised brim 71 and inner raised brim 72 in the diaphragm membrane 70 such that one end of each preliminary-compressing chamber 26 is communicable with each corresponding inlet ports 97 (as enlarged view shown in FIG. 10 of association); and said pump head cover 20, which covers on the pump head body 60 to encompass the piston valvular assembly 90, pumping piston 80 and diaphragm membrane 70 therein, includes a water inlet orifice 21, a water outlet orifice 22, and several fastening bores 23 while a tiered rim 24 and an annular rib ring 25 are disposed in the bottom inside of said pump head cover 20 such that the outer brim for the assembly of diaphragm membrane 70 and piston valvular assembly 90 can hermetically attach on the tiered rim 24 (as enlarged view shown in FIG. 10 of association), wherein a high-compressing chamber 27 is configured between cavity formed by the inside wall of the annular rib ring 25 and the central outlet mount 92 of the piston valvular assembly 90 upon having the bottom of the annular rib ring 25 closely covered on the brim of the central outlet mount 92 (as shown in FIG. 10).

By running each fastening bolt 2 through the each corresponding fastening bores 23 of pump head cover 20 and each corresponding fastening bore 63 in the pump head body 60, then putting a nut 3 onto each fastening bolt 2 to securely screw the pump head cover 20 and pump head body 60 with the motor upper chassis 30 via each corresponding fastening bore 33 in the motor upper chassis 30 so that the whole assembly of the five-compressing-chamber diaphragm pump is finished (as shown in FIGS. 1 and 10).

Please refer to FIGS. 11 and 12, which are illustrative figures for the operation of "conventional five-compressing-chamber diaphragm pump".

Firstly, when the motor 10 is powered on, the wobble plate 40 is driven to rotate by the motor output shaft 11 so that five tubular eccentric roundels 52 on the eccentric roundel mount 50 orderly move in up-and-down reciprocal stroke constantly;

Secondly, meanwhile, five pumping pistons 80 and five piston acting zones 74 in the diaphragm membrane 70 are orderly driven by the up-and-down reciprocal stroke of five tubular eccentric roundels 52 to move in up-and-down displacement;

Thirdly, when the tubular eccentric roundel 52 moves in "down stroke" with pumping piston 80 and piston acting zone 74 in down displacement, the piston disk 98 in the piston valvular assembly 90 is pushed into "open" status so that the tap water W can flow into the preliminary-compressing chamber 26 orderly via water inlet orifice 21 in the pump head cover 20 and inlet ports 97 in the piston valvular assembly 90 (as shown in FIG. 11 and arrowhead indication W in enlarged view of association);

Fourthly, when the tubular eccentric roundel 52 moves in "up stroke" with pumping piston 80 and piston acting zone 74 in up displacement, the piston disk 96 in the piston valvular assembly 90 is pulled into "close" status to compress the tap water W in the preliminary-compressing chamber 26 to increase the water pressure therein up to range of 100 psi-150 psi and become into pressurized water Wp with result that the plastic anti-backflow valve 94 in the piston valvular assembly 90 is pushed to "open" status;

Fifthly, when the plastic anti-backflow valve 94 in the piston valvular assembly 90 is pushed to "open" status, the pressurized water Wp in the preliminary-compressing chamber 26 is directed into high-compressing chamber 27 via group of outlet ports 95 for the corresponding sector in central outlet mount 92, then expelled out of the water outlet orifice 22 in the pump head cover 20 (as shown in FIG. 12 and arrowhead indication Wp in enlarged view of association); and Finally, with orderly iterative action for each group of outlet ports 95 for five sectors in central outlet mount 92, the pressurized water Wp is constantly discharged out of the conventional five-compressing-chamber diaphragm pump for being further RO-filtered by the RO-cartridge so that the final filtered pressurized water Wp can be used in the RO (Reverse Osmosis) purifier or RO water purification system, which is popularly installed on the water supplying apparatus in either the settled home, recreational vehicle or mobile home.

Referring to FIGS. 13 and 14, a primary serious drawback has long-lasting existed in the foregoing "conventional five-compressing-chamber diaphragm pump" as below. As described previously, when the motor 10 is powered on, the wobble plate 40 is driven to rotate by the motor output shaft 11 so that five tubular eccentric roundels 52 on the eccentric roundel mount 50 orderly move in up-and-down reciprocal stroke constantly, and five piston acting zones 74 in the diaphragm membrane 70 are orderly driven by the up-and-down reciprocal stroke of five tubular eccentric roundels 52 to move in up-and-down displacement so that equivalently a reiterative acting force F constantly acting on the bottom side of each said piston acting zone 74.

Meanwhile a plurality of rebounding force Fs is created to react the acting force F exerting on the bottom side of diaphragm membrane 70 with different components distributed over entire bottom area of each corresponding piston acting zone 74 in the diaphragm membrane 70 (as shown in FIG. 14) so that a "squeezing phenomenon" happens on the partial portion of the diaphragm membrane 70, which is incurred by the rebounding force Fs.

Among all distributed components of the rebounding force Fs, the component force happened at the contacting bottom position P of the diaphragm membrane 70 with the rounded shoulder 57 of the horizontal top face 53 in the tubular eccentric roundel 52 is maximum so that the "squeezing phenomenon" happened here is also maximum (as shown in FIG. 14).

With rotational speed for the motor output shaft 11 of the motor 10 reaching a range of 800-1200 rpm, each bottom position P at the piston acting zone 74 of the diaphragm membrane 70 is suffered from the "squeezing phenomenon" in a frequency of five times per second. Under such circumstance, the bottom position P of the diaphragm membrane 70 is always the first broken place for entire conventional five-compressing-chamber diaphragm pump, which is the essential cause for not only shortening the service lifespan but also terminating normal function of the conventional five-compressing-chamber diaphragm pump.

Therefore, how to substantially reduce all the drawbacks associated with the "squeezing phenomenon" caused by the reiterative acting force F constantly acting on the bottom side of each said piston acting zone 74 of the diaphragm membrane 70, which is incurred by the tubular eccentric roundel 52, for the conventional five-compressing-chamber diaphragm pump becomes an urgent and critical issue.

SUMMARY OF THE INVENTION

The primary object of the present invention is to provide a roundel structure for five-compressing-chamber diaphragm pump. The eccentric roundel structure is a cylindrical eccentric roundel, which is disposed in an eccentric roundel mount, basically comprises an annular positioning dent, a vertical flank and a sloped top ring created from the annular positioning dent to the vertical flank. By means of the sloped top ring, the oblique pull and squeezing phenomena of high frequency incurred in a conventional tubular eccentric roundel are completely eliminated because the sloped top ring flatly attaches the bottom area of corresponding piston acting zone for a diaphragm membrane. Thus, not only the durability of the diaphragm membrane for sustaining the pumping action of high frequency from the cylindrical eccentric roundels is mainly enhanced. But also the service lifespan of the diaphragm membrane is exceedingly prolonged.

The other object of the present invention is to provide a roundel structure for five-compressing-chamber diaphragm pump. The eccentric roundel structure is a cylindrical eccentric roundel, which is disposed in an eccentric roundel mount, basically comprises an annular positioning dent, a vertical flank and a sloped top ring created from the annular positioning dent to the vertical flank. By means of the sloped top ring, all distributed components of the rebounding force for the cylindrical eccentric roundels reacting to the an acting force caused by the pumping action are substantially reduced because the sloped top ring flatly attaches the bottom area of corresponding piston acting zone for a diaphragm membrane.

Thus, some benefits are obtained as below.

1. The durability of the diaphragm membrane for sustaining the pumping action of high frequency from the cylindrical eccentric roundels is mainly enhanced.

2. The power consumption of the five-compressing-chamber diaphragm pump is tremendously diminished due to less current being wasted in the "squeezing phenomena" of high frequency.

3. The working temperature of the five-compressing-chamber diaphragm pump is tremendously subdued due to less power consumption being used.

4. The annoying noise of the bearing incurred by the aged lubricant in the five-compressing-chamber diaphragm pump, which is expeditiously accelerated by the high working temperature, is mostly eliminated.

DETAILED DESCRIPTION OF THE PREFERRED EMBODIMENTS

Figure 1:
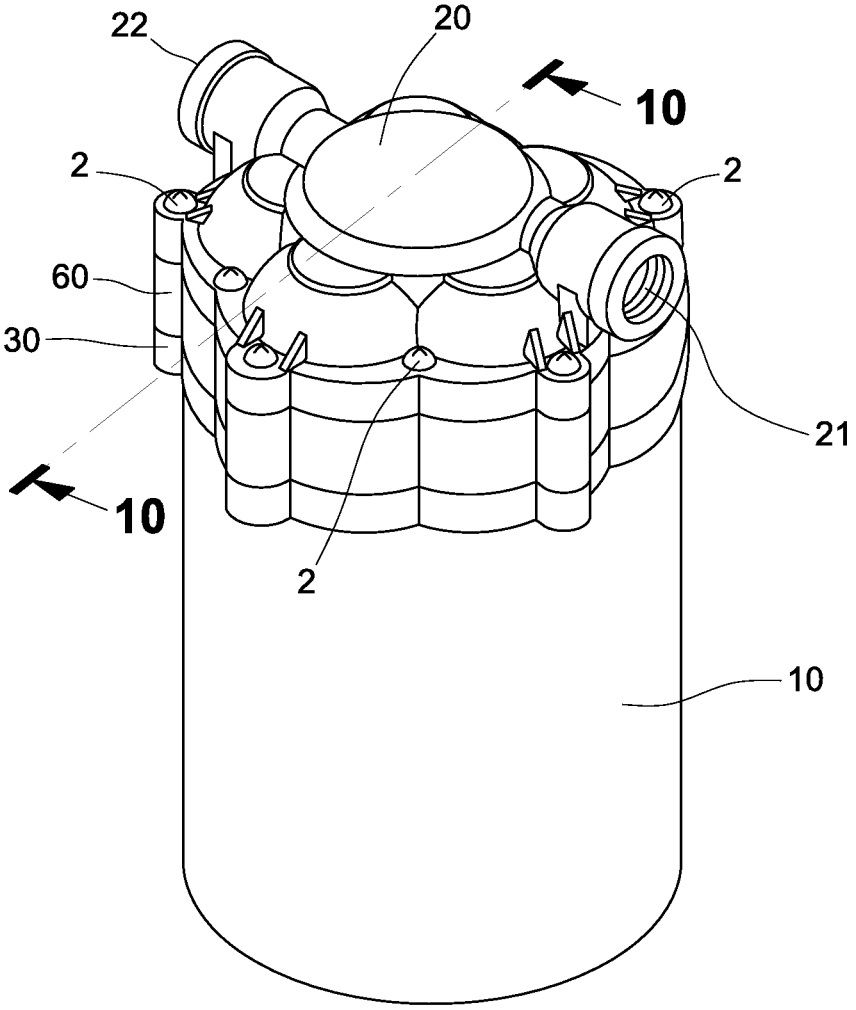
FIG.1 (PRIOR ART)
FIG. 1 is a perspective assembled view for conventional five-compressing-chamber diaphragm pump.
Figure 2:
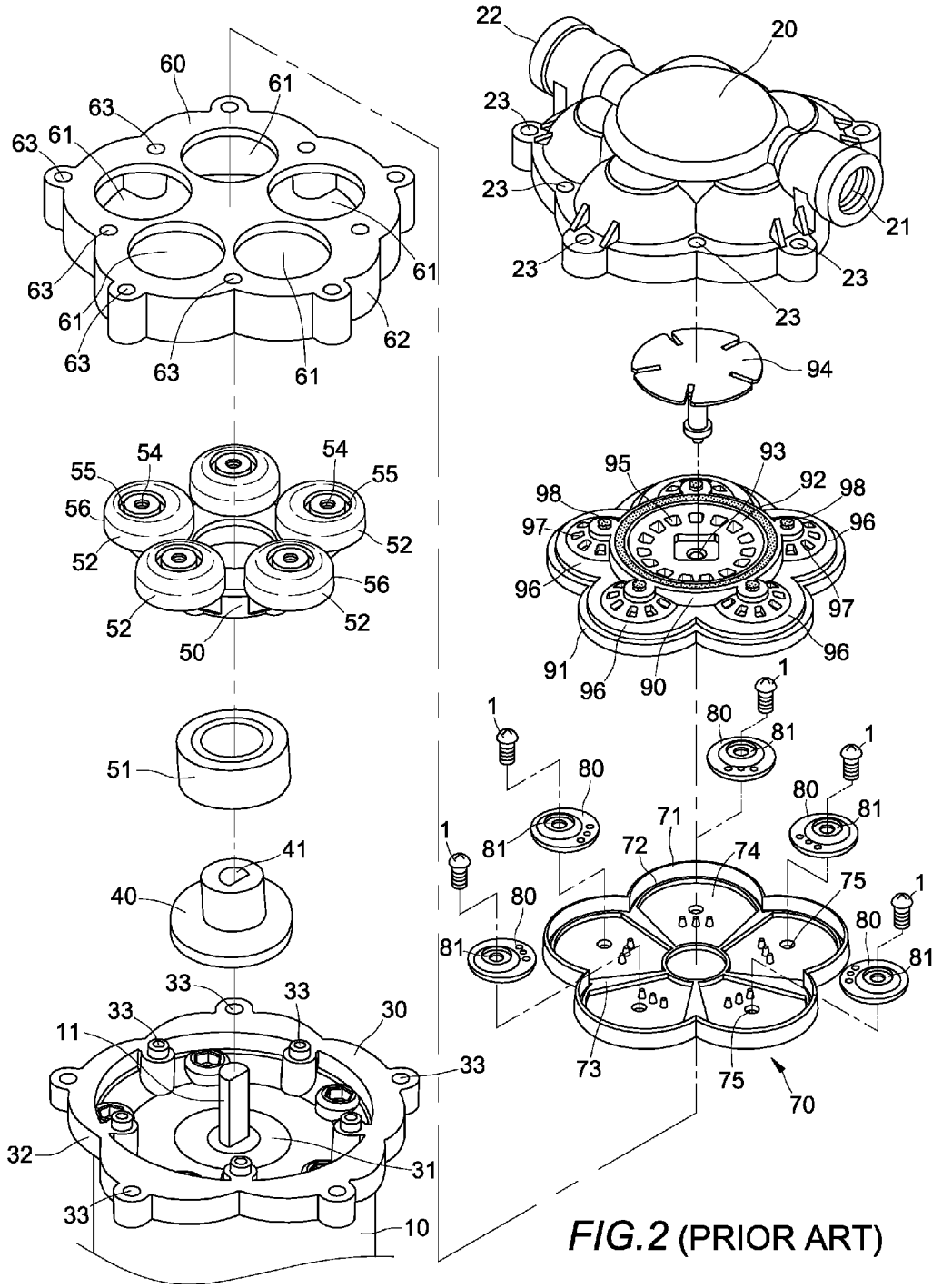
FIG.2 (PRIOR ART)
FIG. 2 is a perspective exploded view for conventional five-compressing-chamber diaphragm pump.
Figure 3:
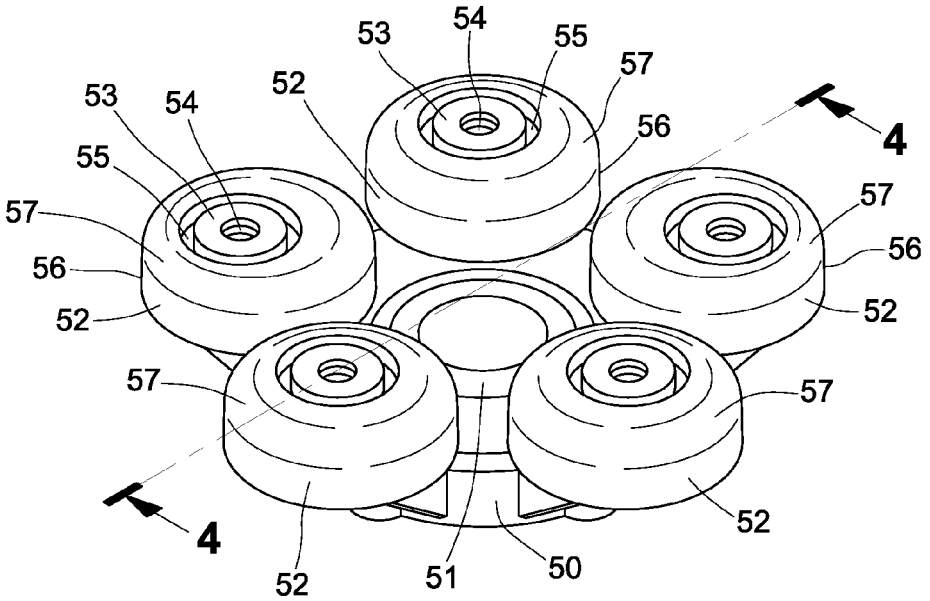
FIG.3 (PRIOR ART)
FIG. 3 is a perspective view for eccentric roundel mount of conventional five-compressing-chamber diaphragm pump.
Figure 4:
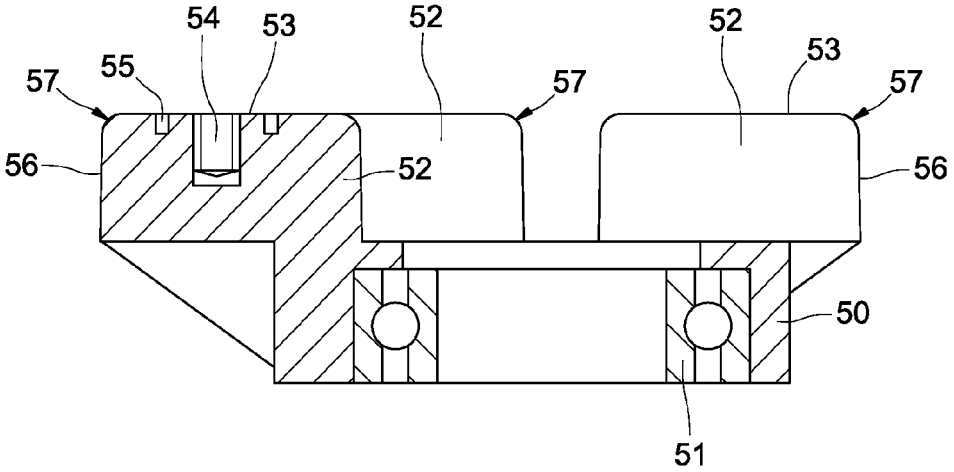
FIG.4 (PRIOR ART)
FIG. 4 is a cross sectional view taken against the section line of 4-4 from previous FIG. 3.
Figure 5:
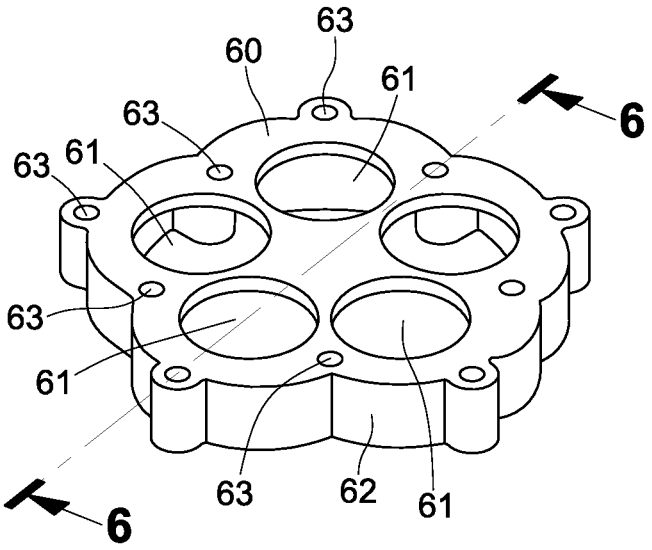
FIG.5 (PRIOR ART)
FIG. 5 is a perspective view for pump head body of conventional five-compressing-chamber diaphragm pump.
Figure 6:
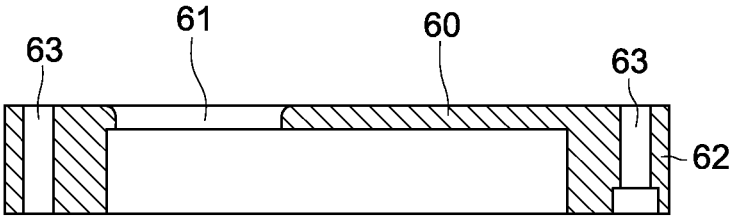
FIG.6 (PRIOR ART)
FIG. 6 is a cross sectional view taken against the section line of 6-6 from previous FIG. 5.
Figure 9:
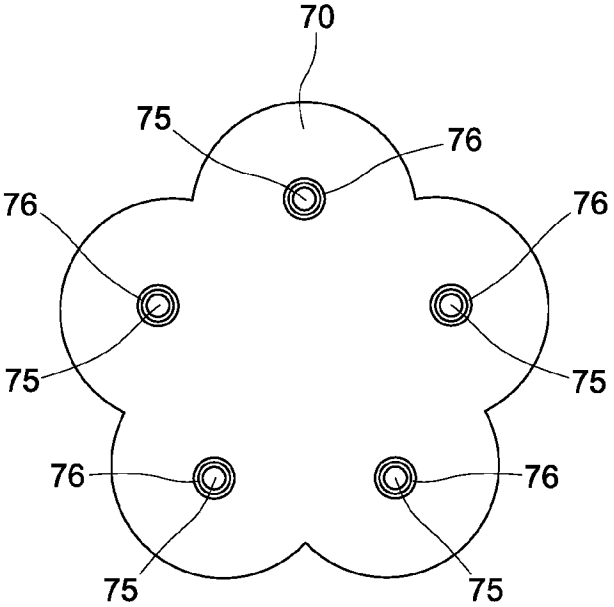
FIG.9 (PRIOR ART)
FIG. 9 is a bottom view for diaphragm membrane of conventional five-compressing-chamber diaphragm pump.
Figure 7:
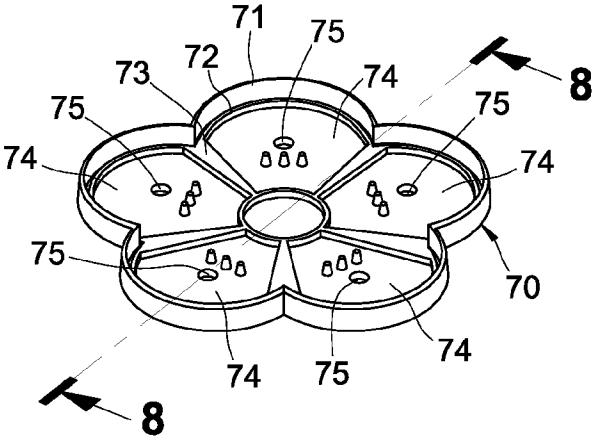
FIG.7 (PRIOR ART)
FIG. 7 is a perspective view for diaphragm membrane of conventional five-compressing-chamber diaphragm pump.
Figure 8:
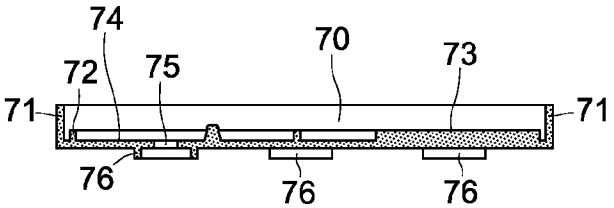
FIG.8 (PRIOR ART)
FIG. 8 is a cross sectional view taken against the section line of 8-8 from previous FIG. 7.
Figure 10:
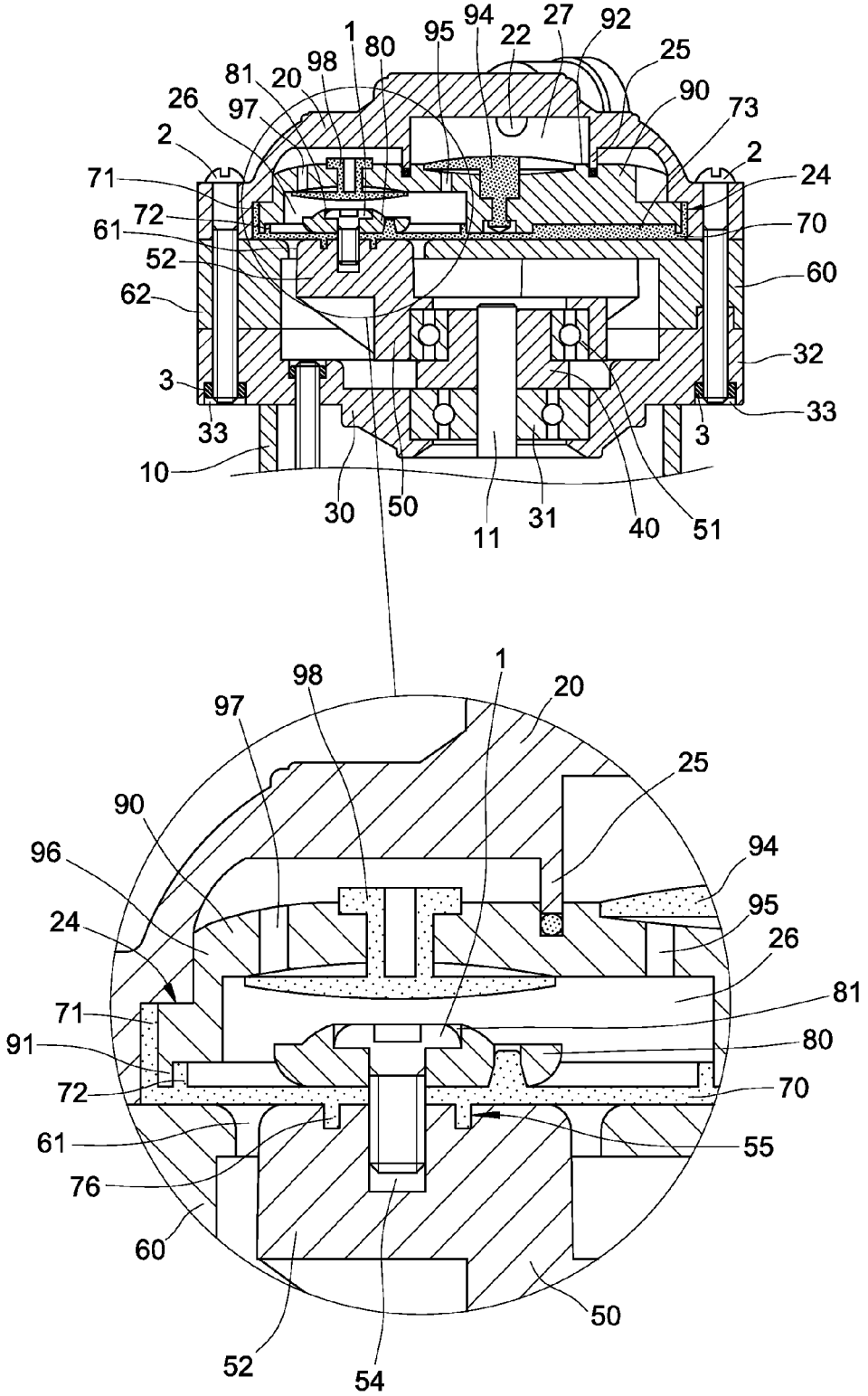
FIG.10 (PRIOR ART)
FIG. 10 is a cross sectional view taken against the section line of 10-10 from previous FIG. 1.
Figure 11:
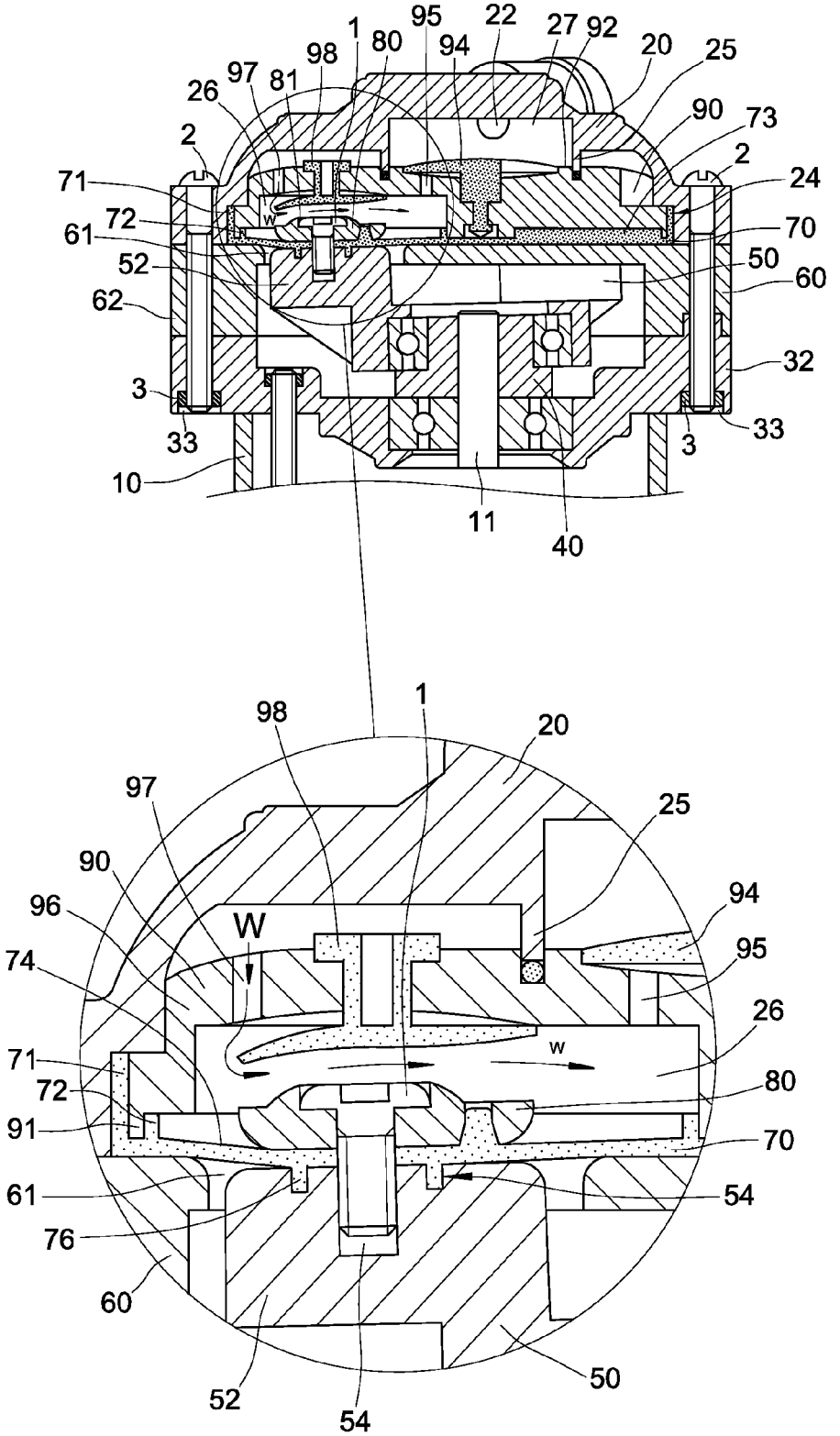
FIG.11 (PRIOR ART)
FIG. 11 is the first operation illustrative view for conventional five-compressing-chamber diaphragm pump.
Figure 12:
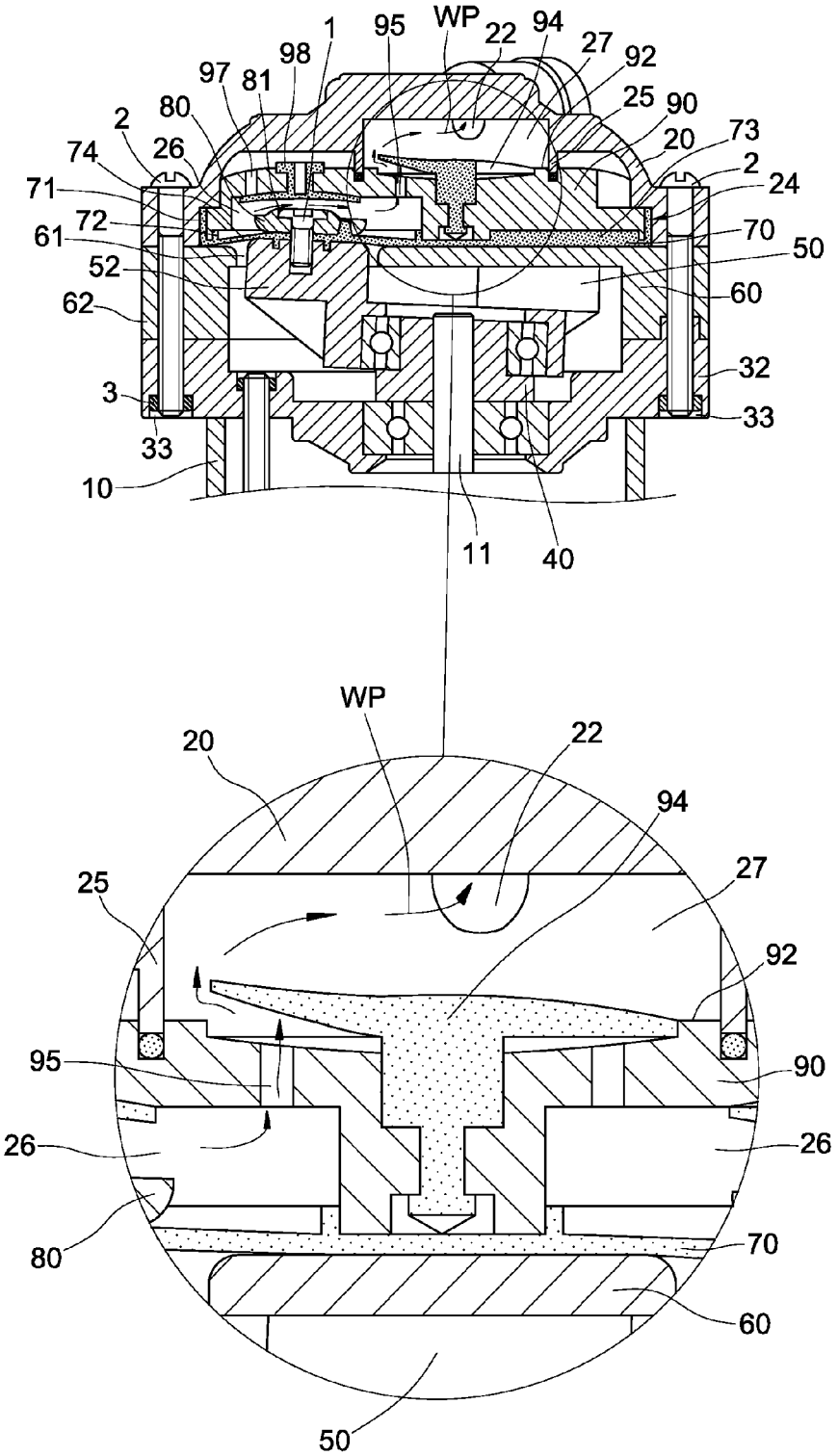
FIG.12 (PRIOR ART)
FIG. 12 is the second operation illustrative view for conventional five-compressing-chamber diaphragm pump.
Figure 13:
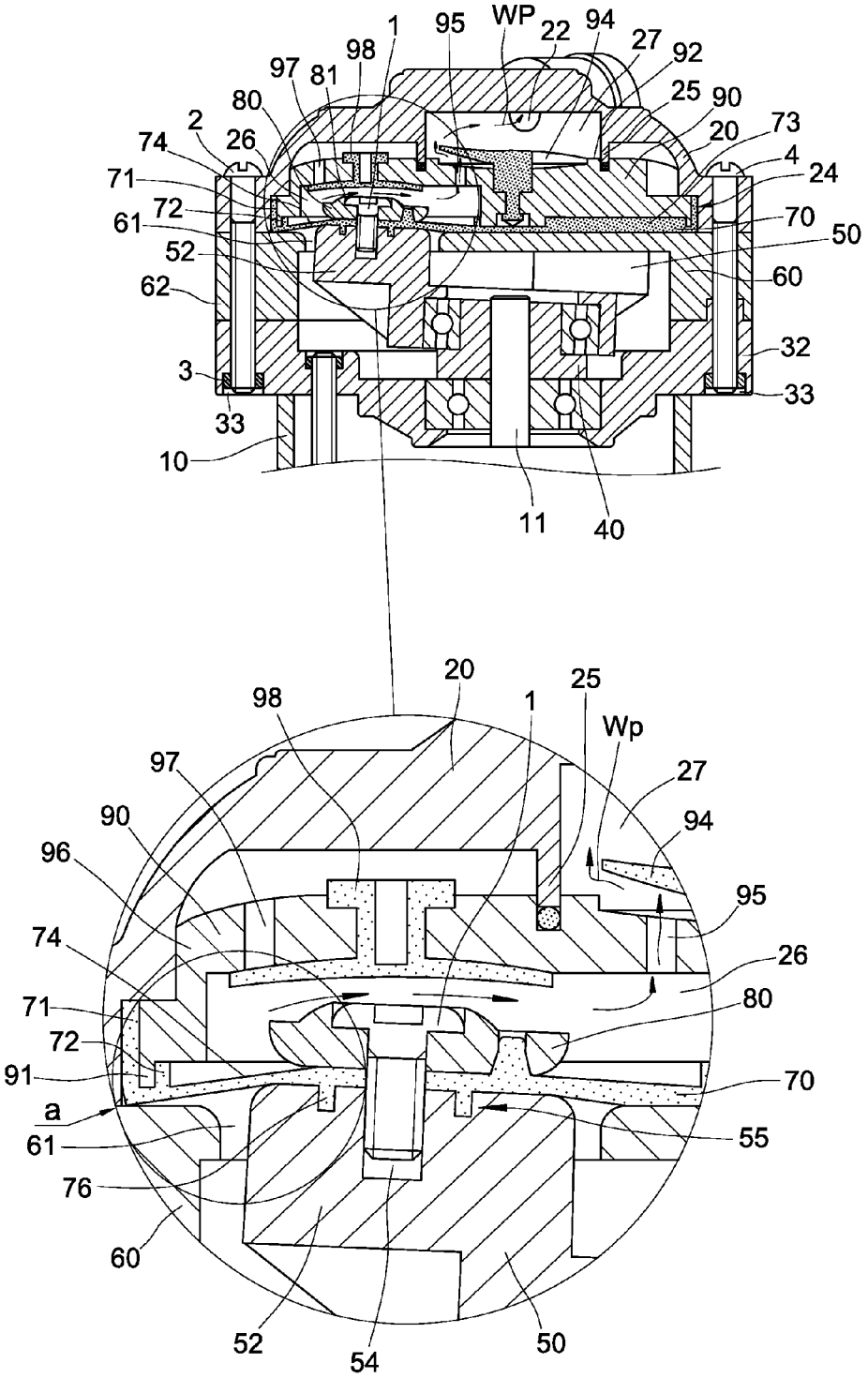
FIG.13 (PRIOR ART)
FIG. 13 is the third operation illustrative view for conventional five-compressing-chamber diaphragm pump.

Please refer to FIGS. 15 through 18, which are illustrative figures of "roundel structure for five-compressing-chamber diaphragm pump" in the first exemplary embodiment of the present invention.

The roundel structure is a cylindrical eccentric roundel 52 in an eccentric roundel mount 50.

The cylindrical eccentric roundel 52 basically comprises a sloped top ring 58 created from the annular positioning dent 55 to the vertical flank 56 to replace the conventional rounded shoulder 57 in each tubular eccentric roundel 52 of the eccentric roundel mount 50.

Figure 19:
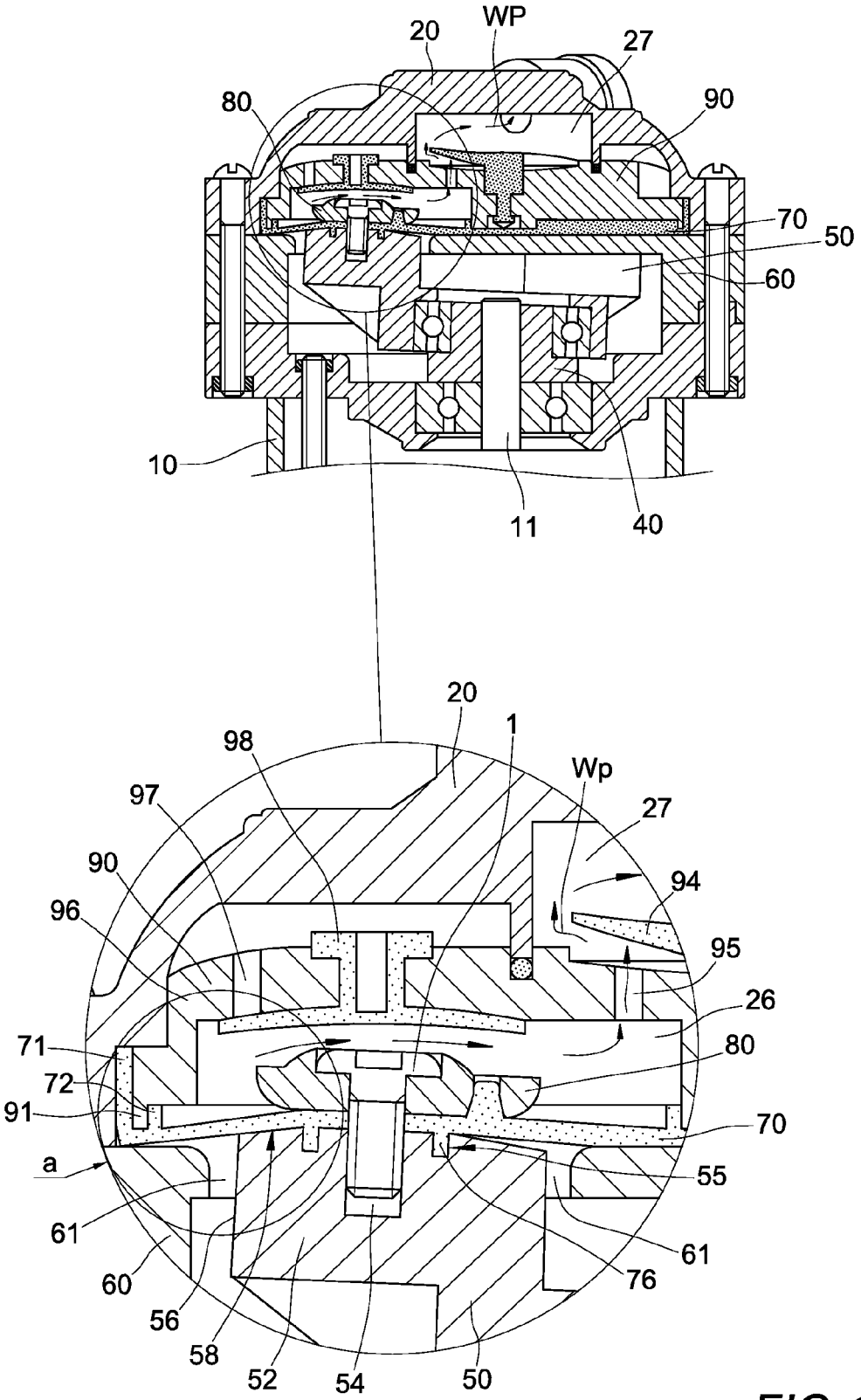
FIG. 19 is an operation illustrative view for the first exemplary embodiment of the present invention.
Figure 20:
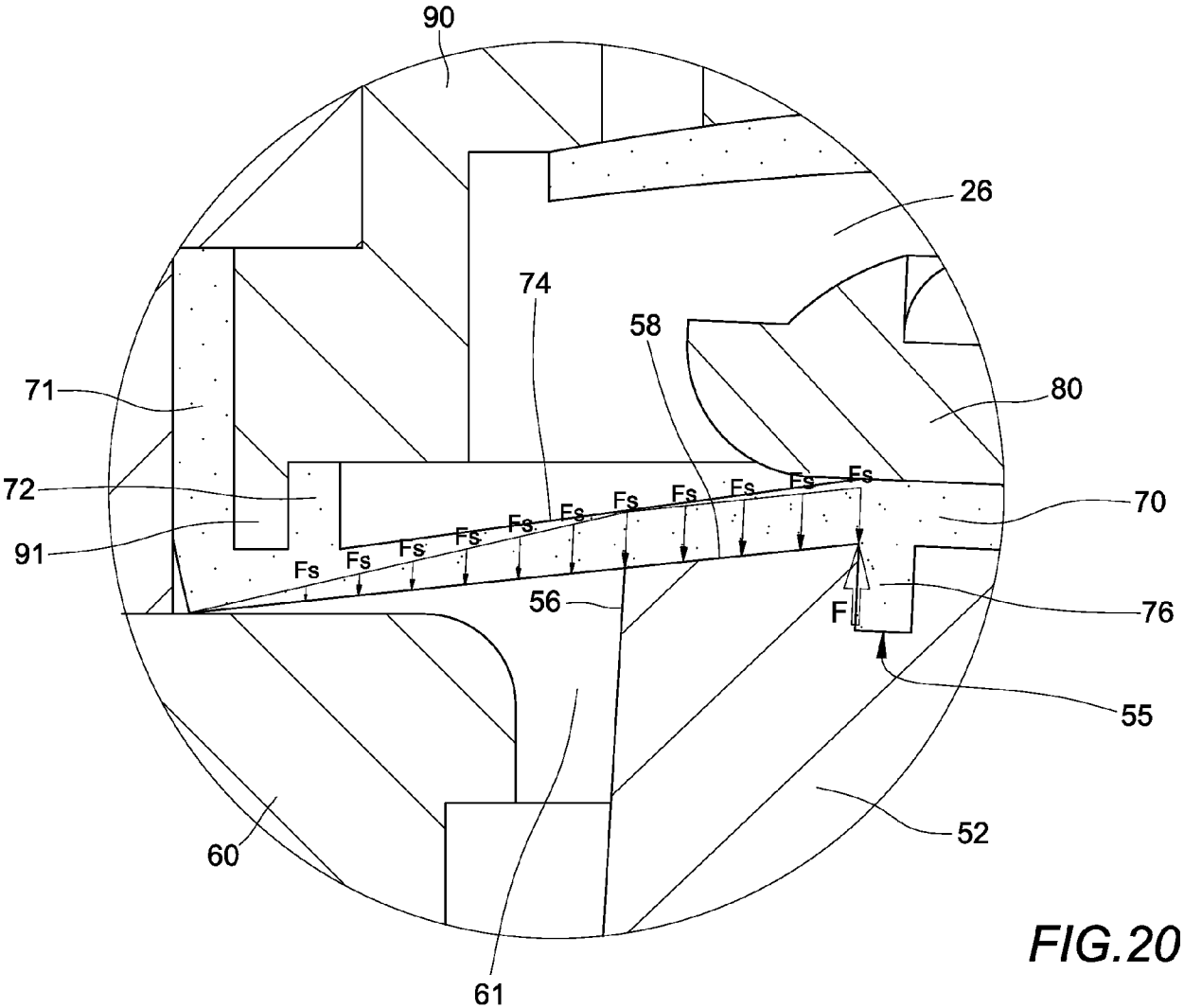
FIG. 20 is a partially enlarged view taken from circled-portion-a of previous FIG. 19.
Figure 21:
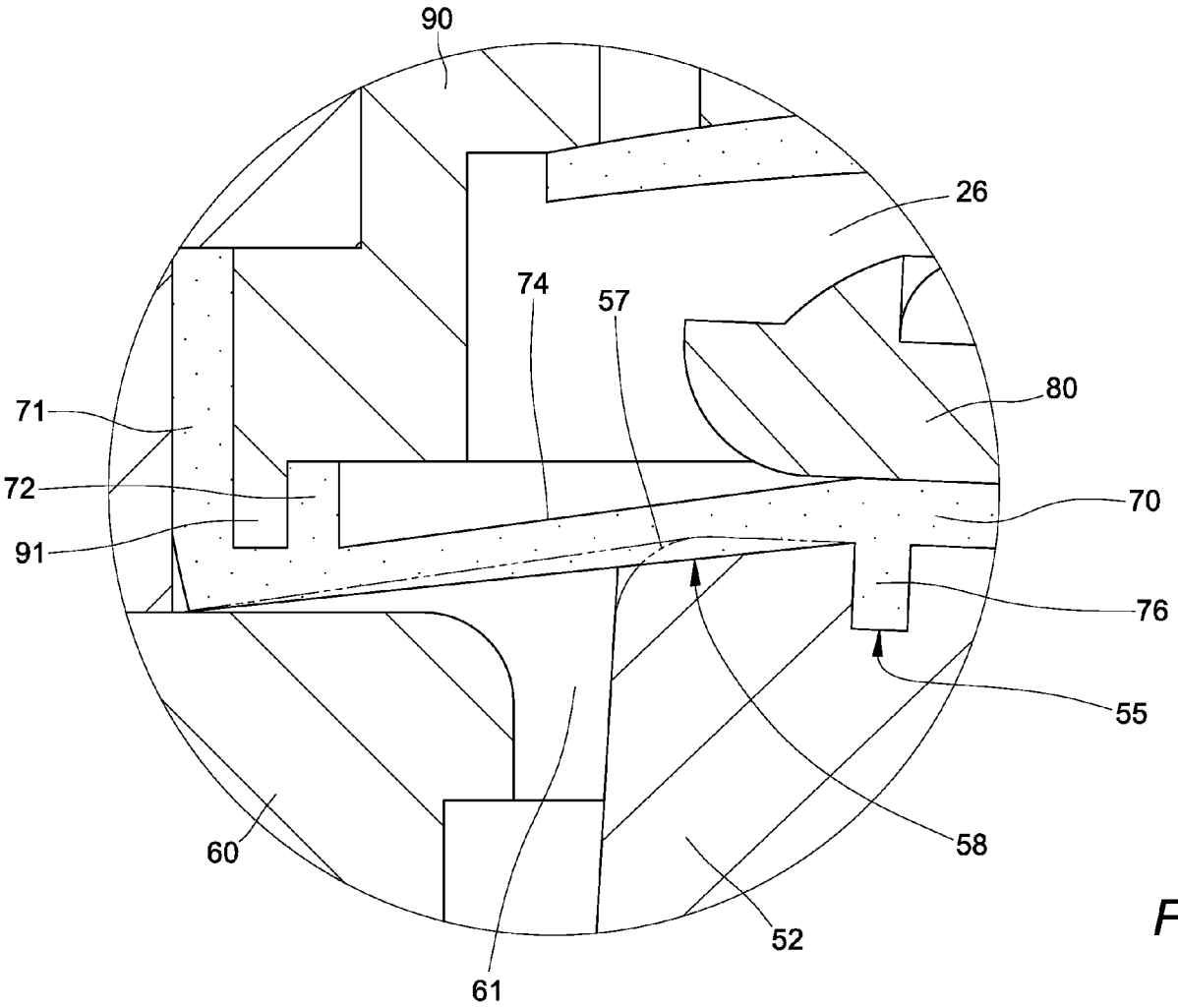
FIG. 21 is an illustrative view showing the contrastive comparison of the cylindrical eccentric roundel acting the diaphragm membrane for the conventional five-compressing-chamber diaphragm pump and the present invention in the first exemplary embodiment of the present invention.

Please refer to FIGS. 19 through 21, which are illustrative figures for the operation of the "roundel structure for five-compressing-chamber diaphragm pump" in the first exemplary embodiment of the present invention.

Figure 14:
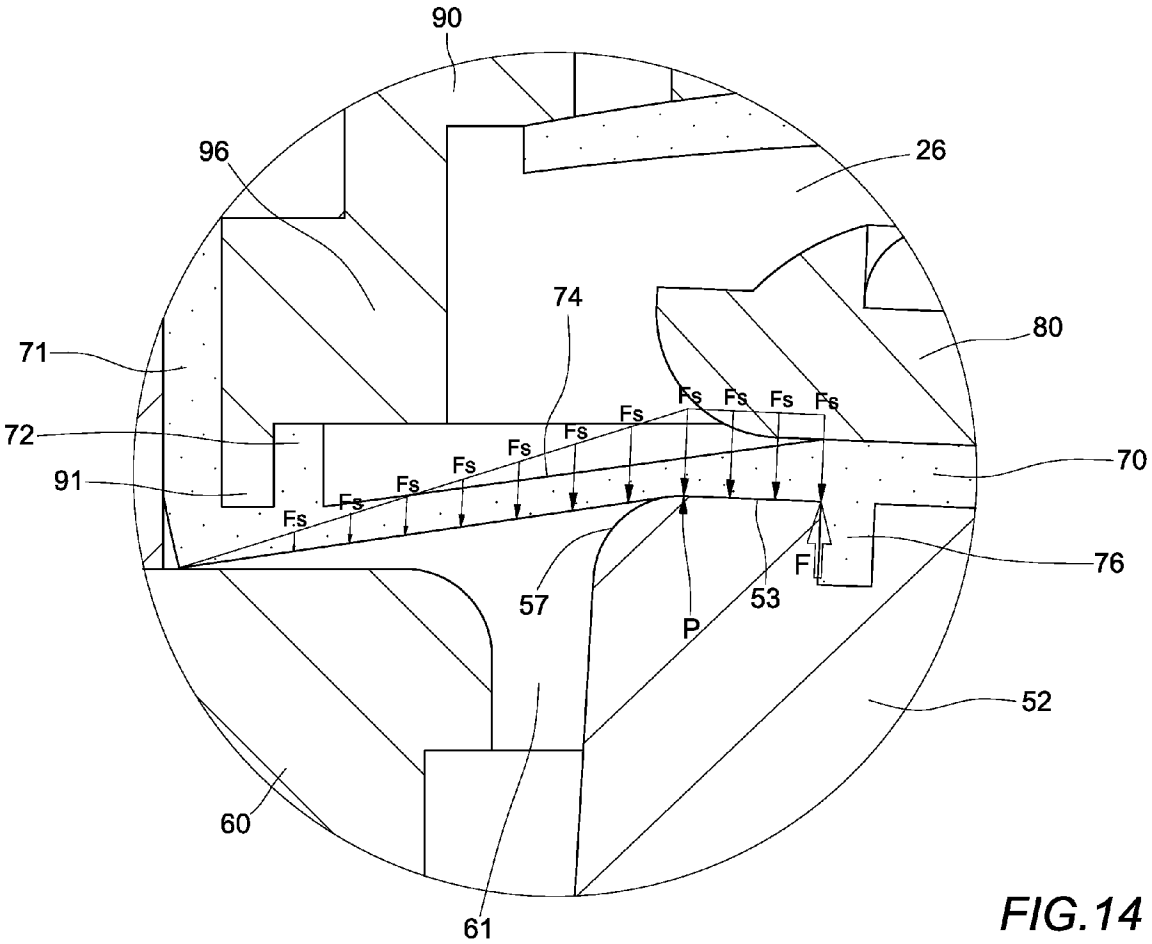
FIG. 14 (PRIOR ART)
FIG. 14 is a partially enlarged view taken from circled-portion-a of previous FIG. 13.
Figure 15:
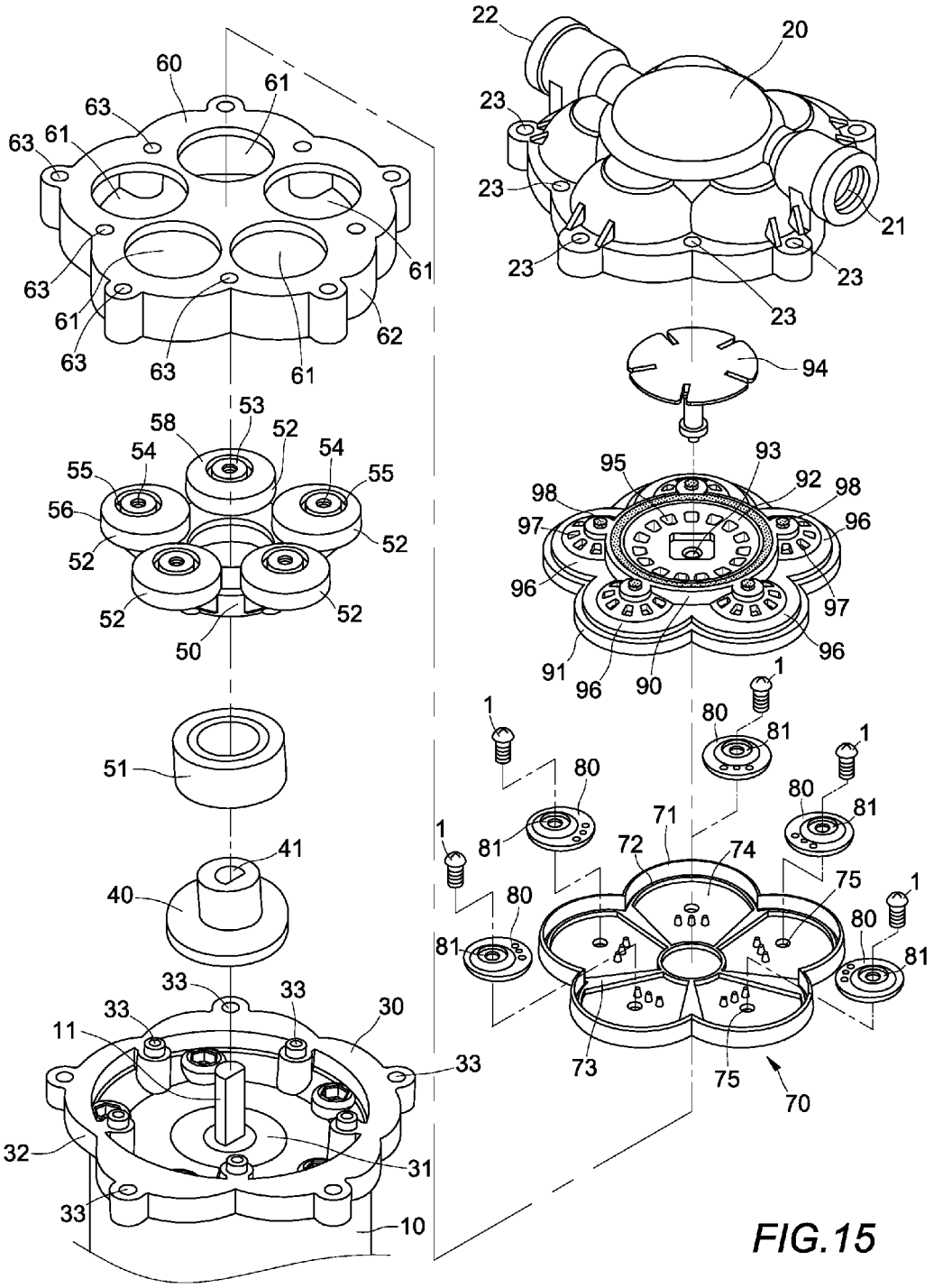
FIG. 15 is a perspective exploded view for the first exemplary embodiment of the present invention.
Figure 16:
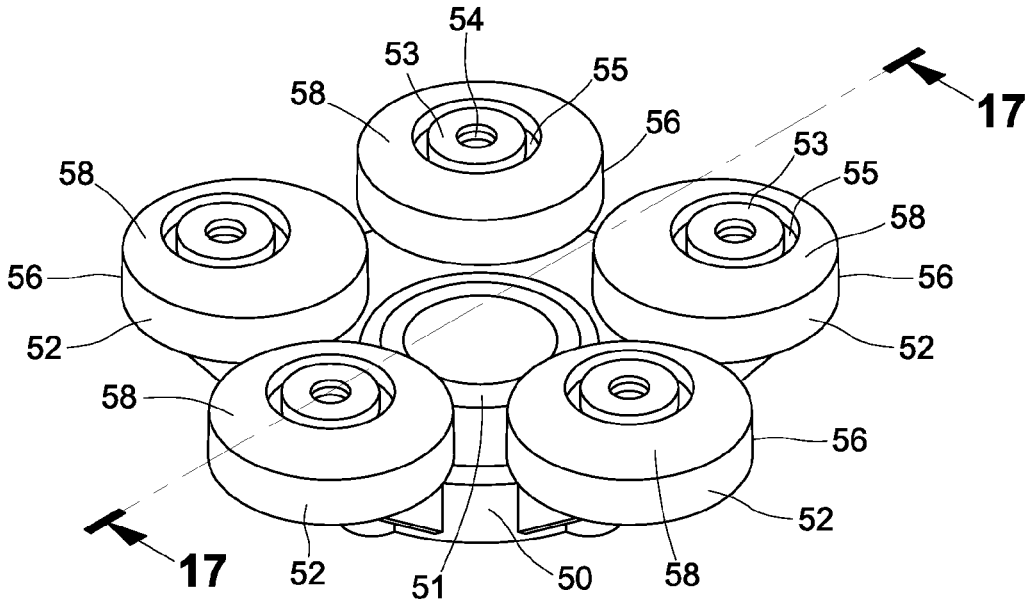
FIG. 16 is a perspective view for eccentric roundel mount in the first exemplary embodiment of the present invention.
Figure 17:
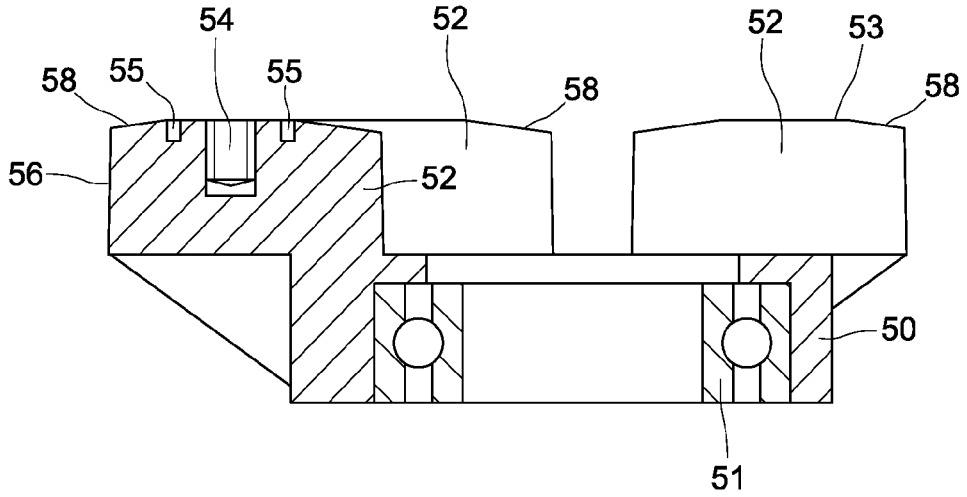
FIG. 17 is a cross sectional view taken against the section line of 17-17 from previous FIG. 16.
Figure 18:
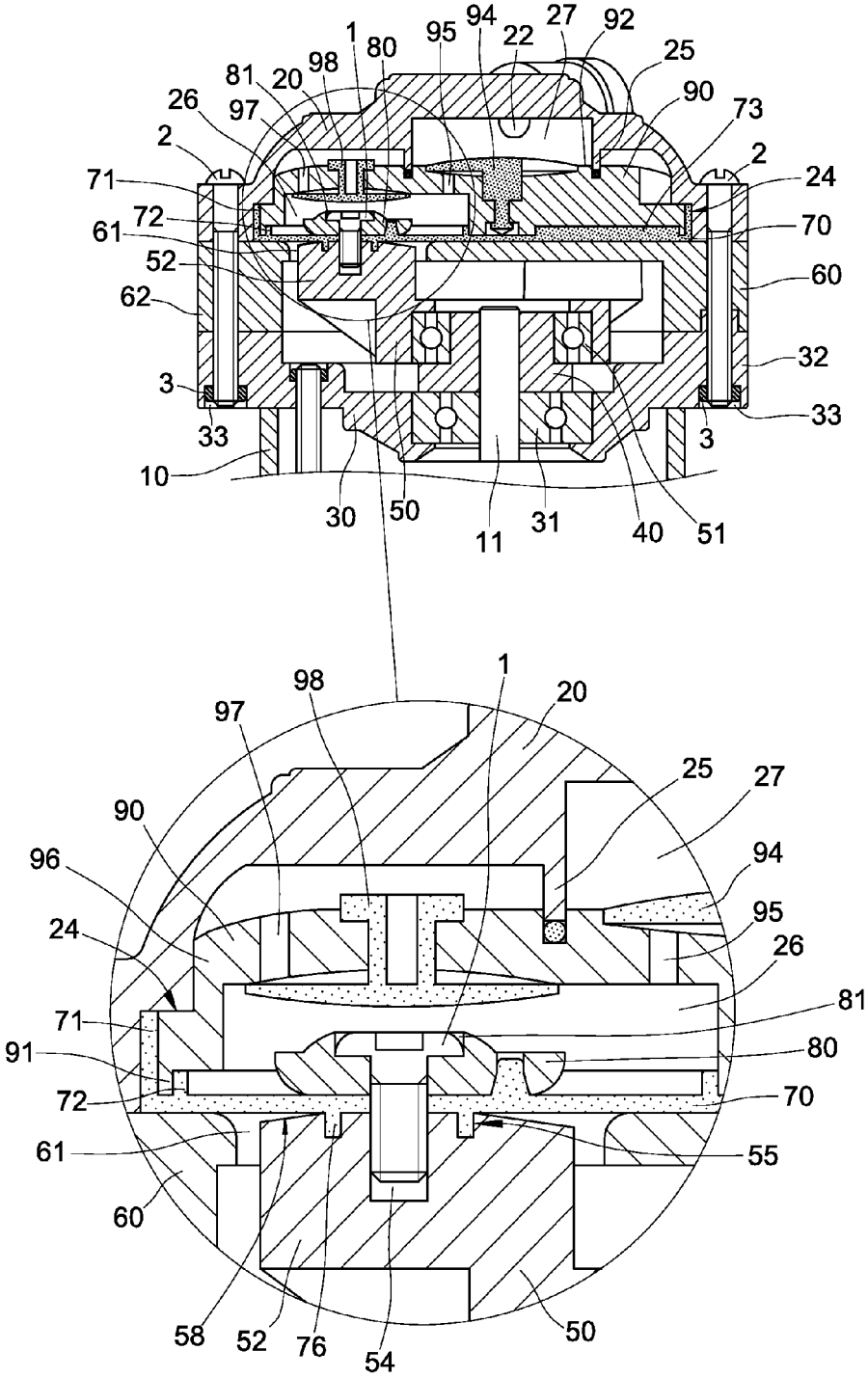
FIG. 18 is an assembled cross sectional view for the first exemplary embodiment of the present invention.

Firstly, when the motor 10 is powered on, the wobble plate 40 is driven to rotate by the motor output shaft 11 so that five cylindrical eccentric roundels 52 on the eccentric roundel mount 50 orderly move in up-and-down reciprocal stroke constantly;

Secondly, five piston acting zones 74 in the diaphragm membrane 70 are orderly driven by the up-and-down reciprocal stroke of five cylindrical eccentric roundels 52 to move in up-and-down displacement;

Thirdly, when the tubular eccentric roundel or cylindrical eccentric roundel 52 moves in "up stroke" with piston acting zone 74 in up displacement, an acting force F will obliquely pull the partial portion between corresponding annular positioning protrusion 76 and outer raised brim 71 of the diaphragm membrane 70;

Please refer to FIGS. 14 and 20. By comparing to the operations between the conventional tubular eccentric roundels 52 and the cylindrical eccentric roundels 52 of the present invention, at least two differences are obtained as below.

In the case of conventional tubular eccentric roundel 52, among all distributed components of the rebounding force Fs, the component force happened at the contacting bottom position P of the diaphragm membrane 70 with the rounded shoulder 57 of the horizontal top face 53 in the tubular eccentric roundel 52 is maximum so that the "squeezing phenomenon" happened here is also maximum (as shown in FIG. 14). With such nonlinear distribution of the "squeezing phenomena", the obliquely pulling action becomes severe. Whereas, in the case of cylindrical eccentric roundels 52, all distributed components of the rebounding force Fs seem rather linear because the sloped top ring 58 therein flatly attaches the bottom area of the piston acting zone 74 for the diaphragm membrane 70 so that the obliquely pulling action almost eliminated due to no "squeezing phenomenon" (as shown in FIGS. 19 and 20).

Moreover, under the same acting force F, the rebounding force Fs is inversely proportional to the contact area so that all distributed components of the rebounding force Fs for the cylindrical eccentric roundels 52 of the present invention (as shown in FIG. 20) are substantially less than all distributed components of the rebounding force Fs for the conventional tubular eccentric roundel 52 (as shown in FIG. 14).

From above comparison, two advantages are inherited by means of the sloped top ring 58 created from the annular positioning dent 55 to the vertical flank 56 in the eccentric roundel mount 50. First, the susceptible breakage of the diaphragm membrane 70 caused by the "squeezing phenomena" of high frequency, which is incurred by the rounded shoulder 57 of the horizontal top face 53 in the tubular eccentric roundel 52, is completely eliminated. Second, the rebounding force Fs of the diaphragm membrane 70 caused by the acting force F, which is incurred by the orderly up-and-down displacement of five piston acting zones 74 in the diaphragm membrane 70 driven by the up-and-down reciprocal stroke of five tubular eccentric roundels or cylindrical eccentric roundels 52, is tremendously reduced.

Therefore, from above inherited advantages, some benefits are obtained as below.

1. The durability of the diaphragm membrane 70 for sustaining the pumping action of high frequency from the cylindrical eccentric roundels 52 is mainly enhanced.

2. The power consumption of the five-compressing-chamber diaphragm pump is tremendously diminished due to less current being wasted in the "squeezing phenomena" of high frequency.

3. The working temperature of the five-compressing-chamber diaphragm pump is tremendously subdued due to less power consumption being used.

4. The annoying noise of the bearing incurred by the aged lubricant in the five-compressing-chamber diaphragm pump, which is expeditiously accelerated by the high working temperature, is mostly eliminated.

Through practical pilot test for the sample of the present invention, the testing results are shown as below.

A. The service lifespan of the diaphragm membrane 70 is exceedingly extended over doubleness.

B. The diminished electric current is over 1 ampere.

C. The subdued working temperature is over 15 degree of Celsius.

D. The smoothness of the bearing is better improved.

Figure 22:
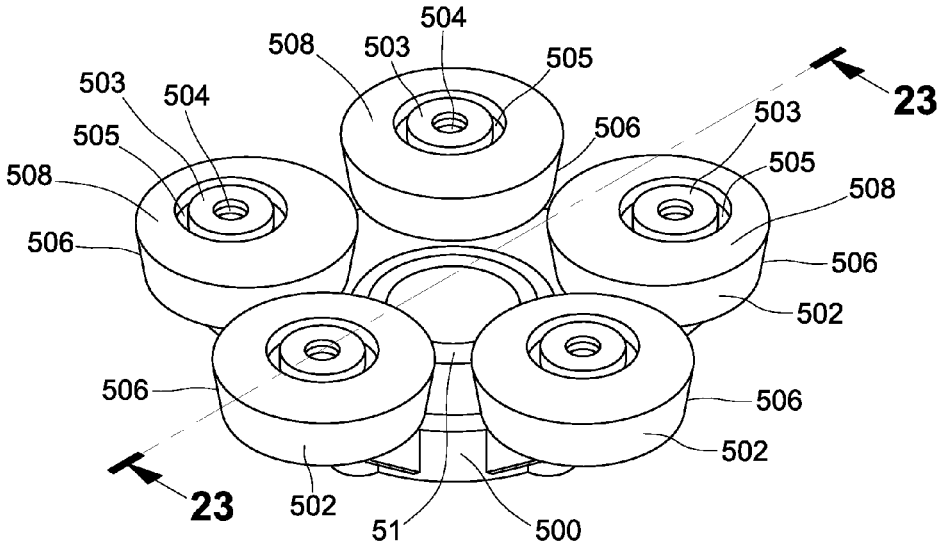
FIG. 22 is a perspective view for eccentric roundel mount in the second exemplary embodiment of the present invention.
Figure 23:
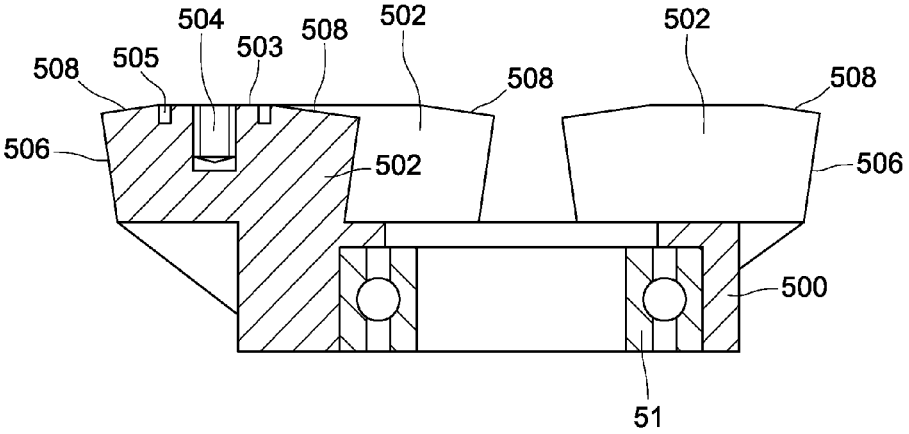
FIG. 23 is a cross sectional view taken against the section line of 23-23 from previous FIG. 22.
Figure 24:
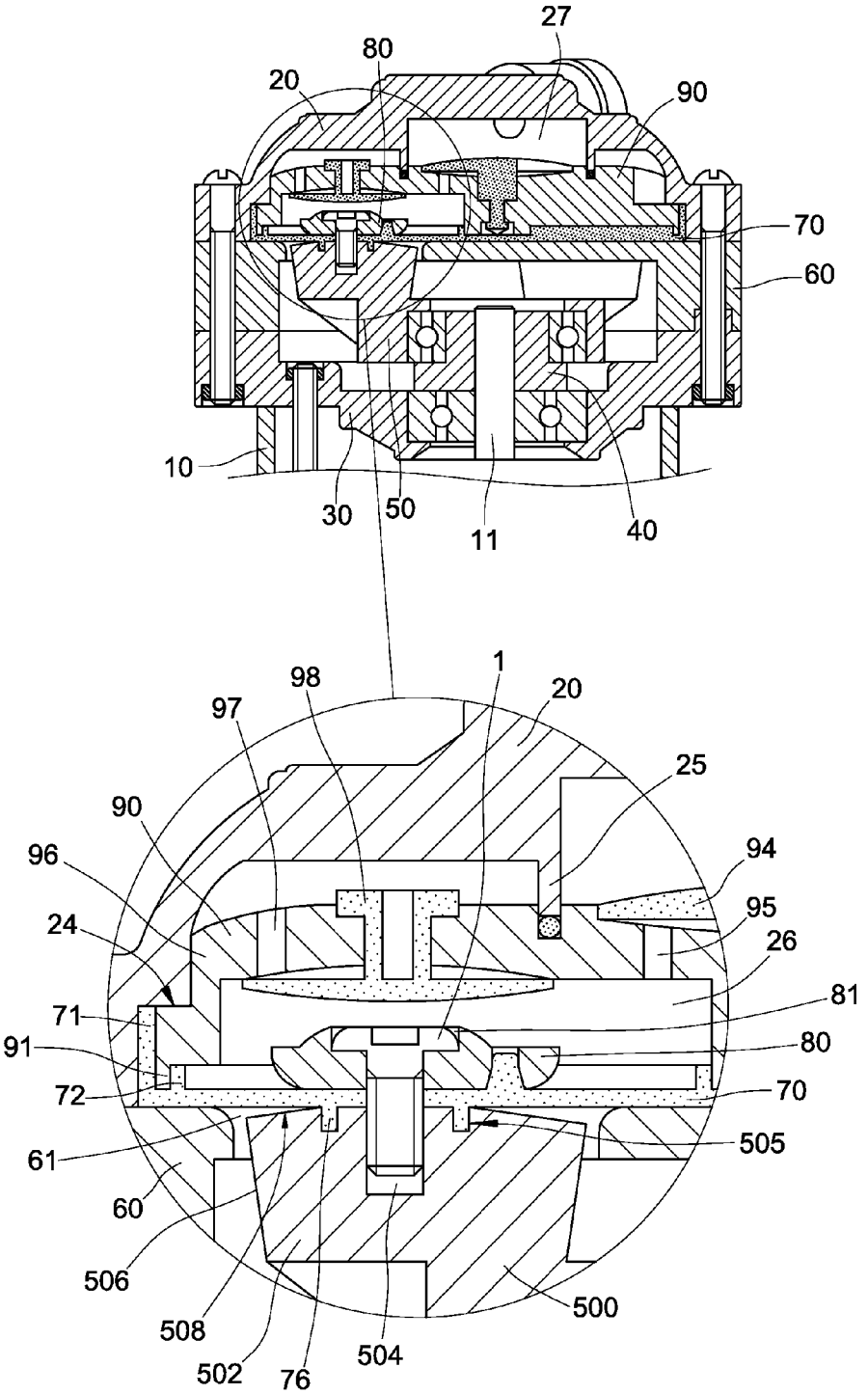
FIG. 24 is an assembled cross sectional view for the second exemplary embodiment of the present invention.

Please refer to FIGS. 22 through 24, which are illustrative figures of "roundel structure for five-compressing-chamber diaphragm pump" in the second exemplary embodiment of the present invention.

The roundel structure is an inverted conical frustum eccentric roundel 502 in an eccentric roundel mount 500.

The conical frustum eccentric roundel 502 basically comprises an integral inverted conical frustum flank 506 and a sloped top ring 508 such that the outer diameter of the conical frustum eccentric roundel 502 is enlarged but still smaller than the inner diameter of the operating hole 61 in the pump head body 60, as well as the sloped top ring 508 is created from an annular positioning dent 505 to the inverted conical frustum flank 506.

Figure 25:
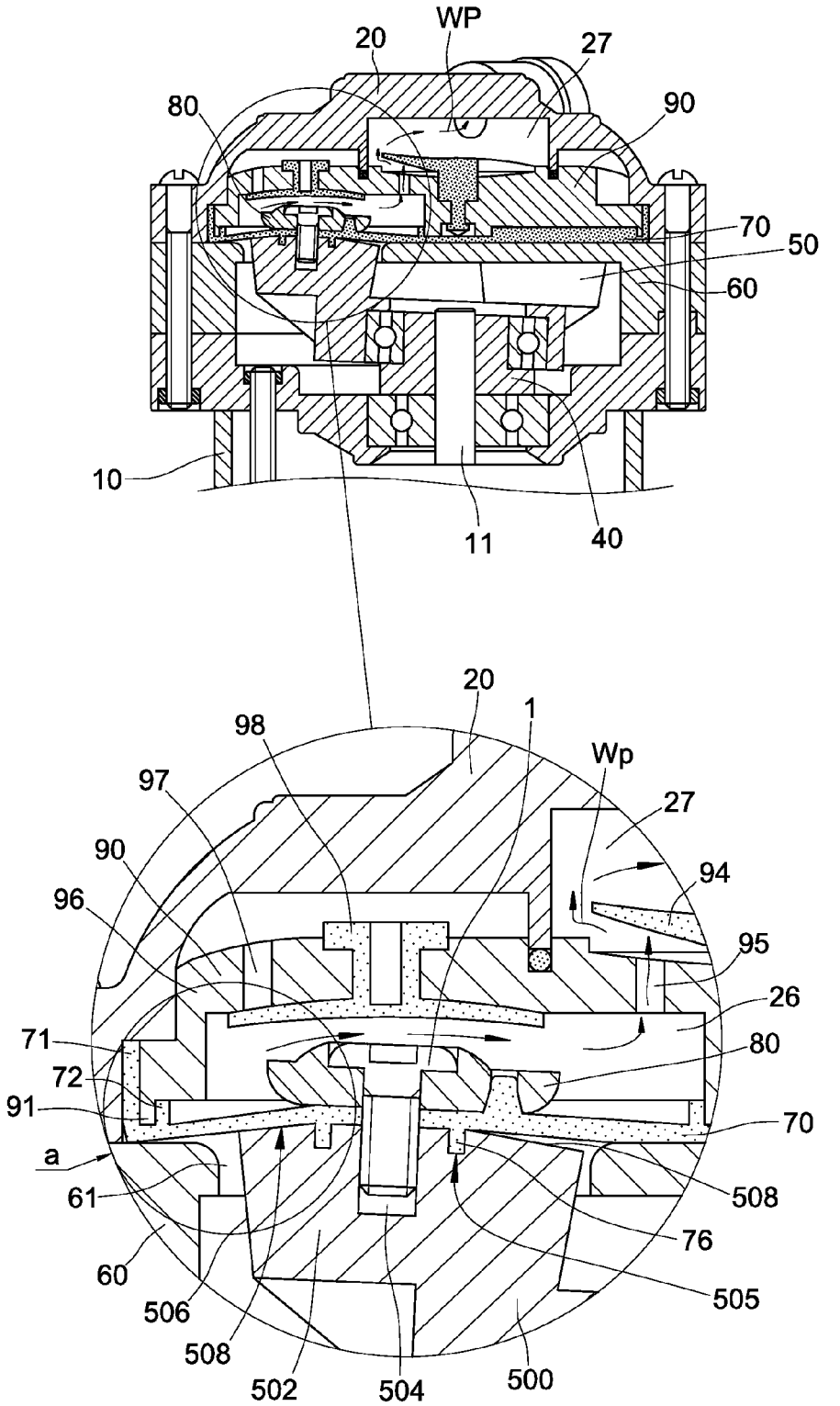
FIG. 25 is an operation illustrative view for the second exemplary embodiment of the present invention.
Figure 26:
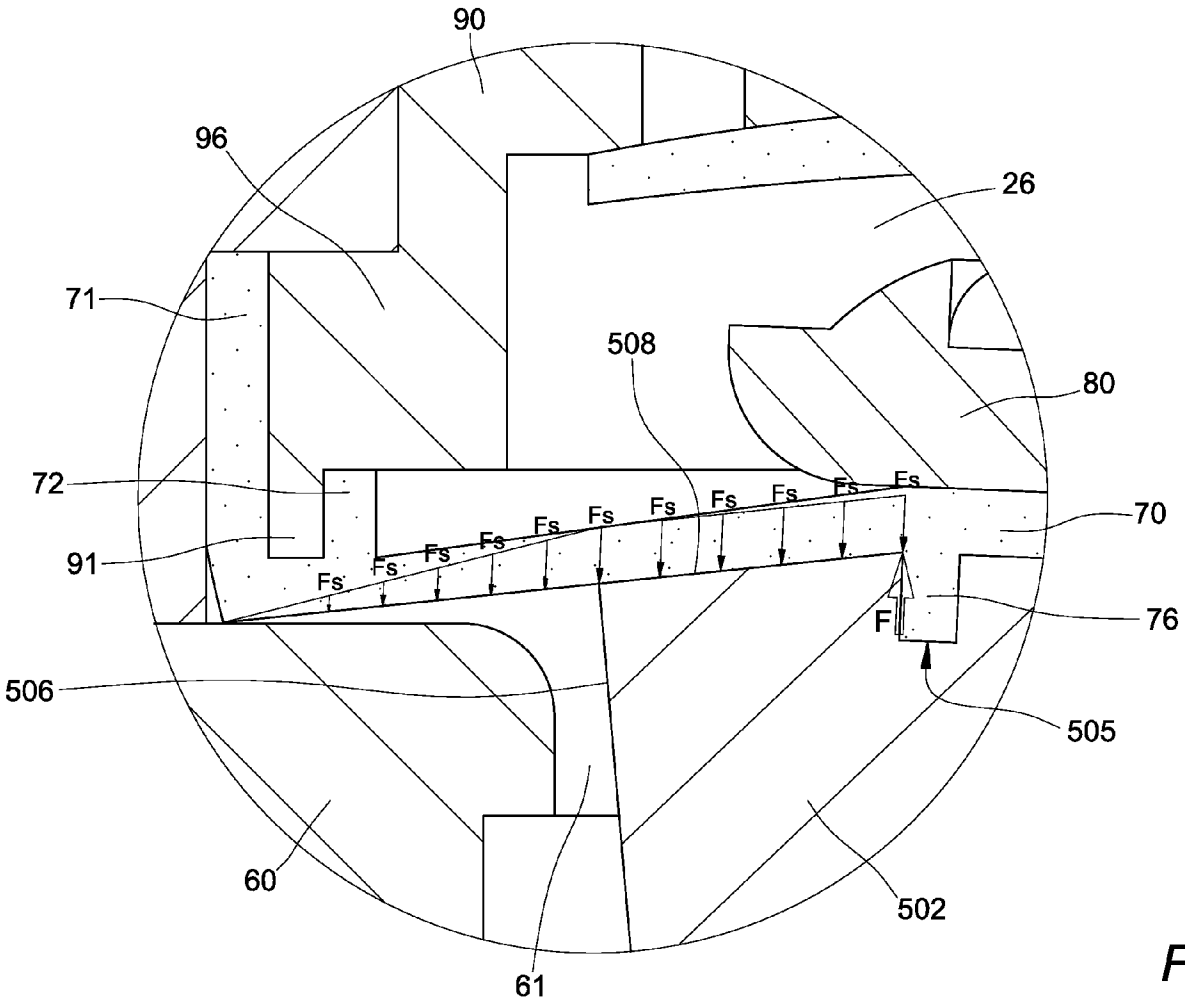
FIG. 26 is a partially enlarged view taken from circled-portion-a of previous FIG. 25.
Figure 27:
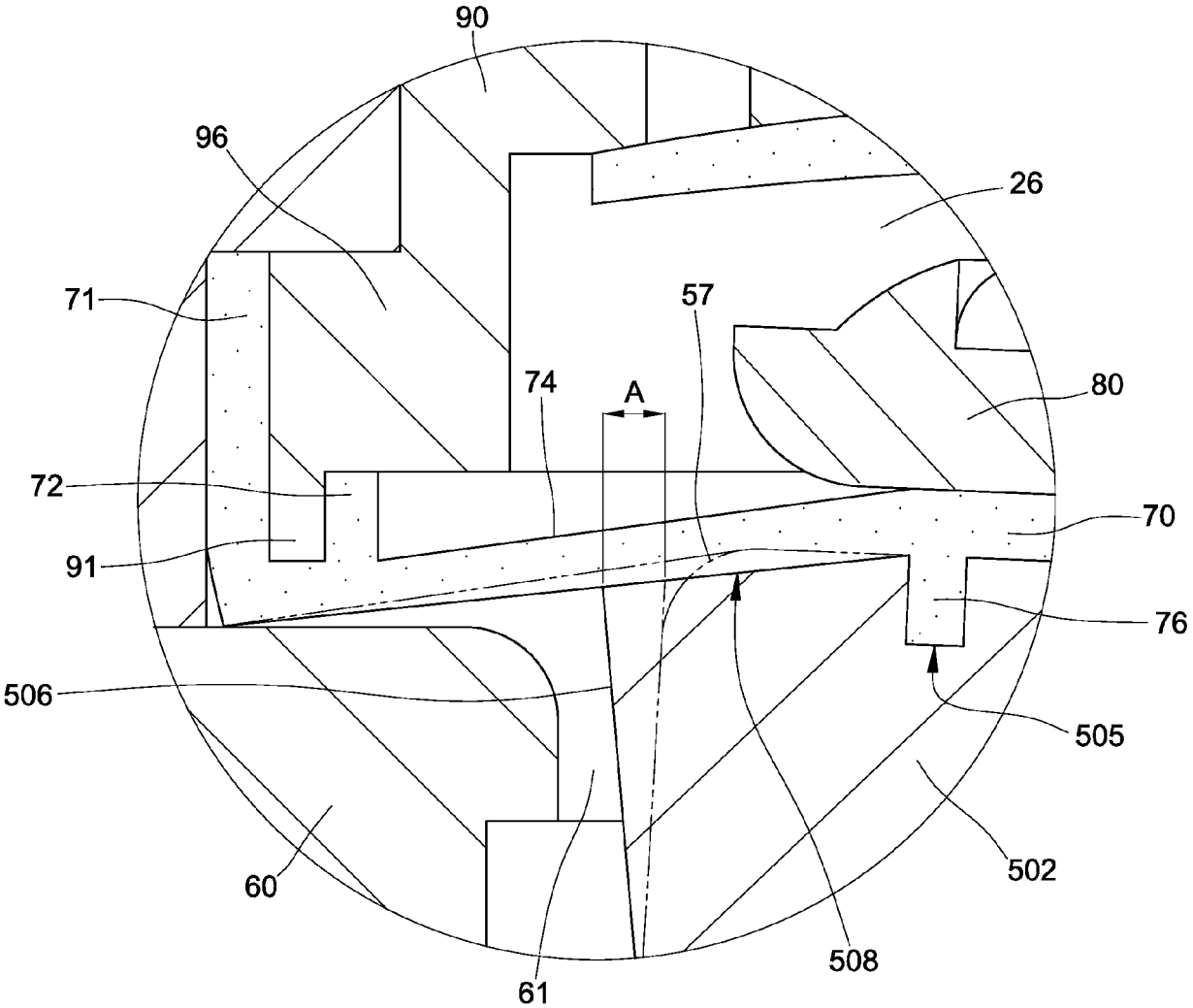
FIG. 27 is an illustrative view showing the contrastive comparison of the cylindrical eccentric roundel acting the diaphragm membrane for the conventional five-compressing-chamber diaphragm pump and the present invention in the second exemplary embodiment of the present invention.
Figure 28:
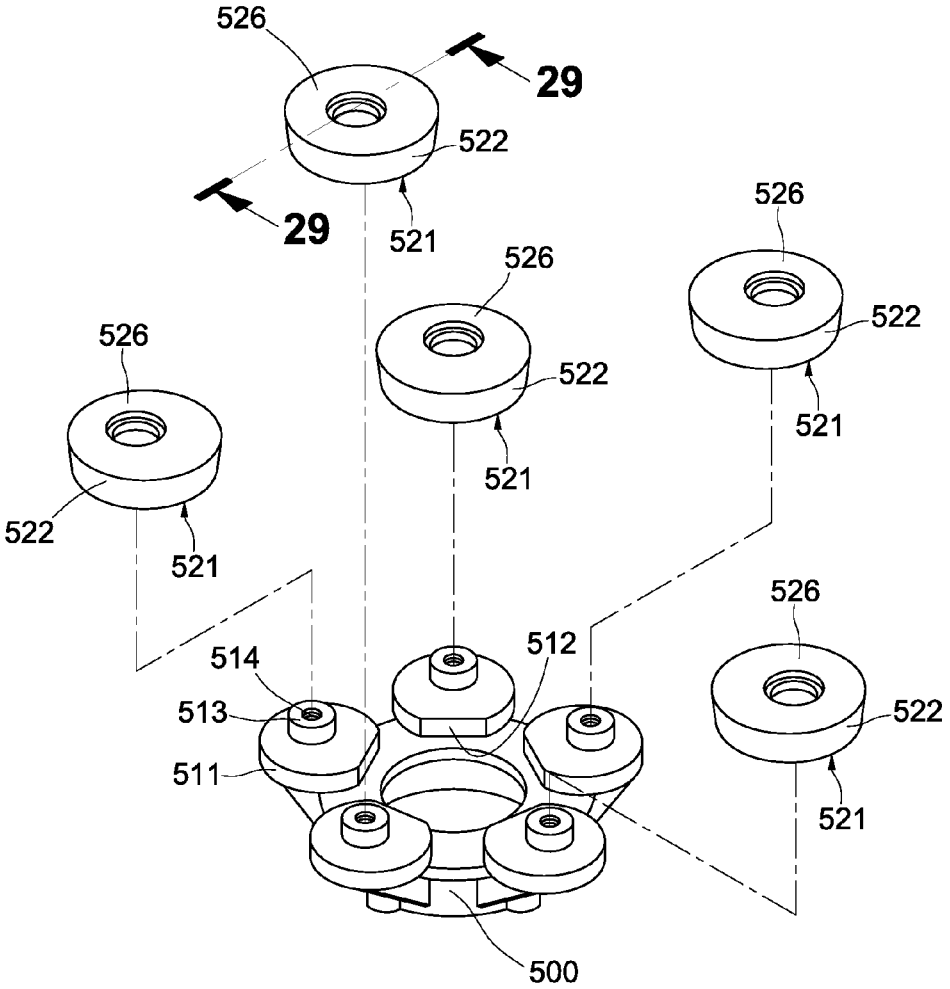
FIG. 28 is a perspective exploded view for the third exemplary embodiment of the present invention.
Figure 29:
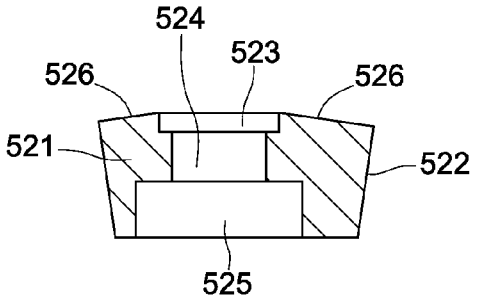
FIG. 29 is a cross sectional view taken against the section line of 29-29 from previous FIG. 28.

Please refer to FIGS. 25 through 27, which are illustrative figures for the operation of the "roundel structure for five-compressing-chamber diaphragm pump" in the second exemplary embodiment of the present invention.

Firstly, when the motor 10 is powered on, the wobble plate 40 is driven to rotate by the motor output shaft 11 so that five conical frustum eccentric roundel 502 on the eccentric roundel mount 500 orderly move in up-and-down reciprocal stroke constantly;

Secondly, five piston acting zones 74 in the diaphragm membrane 70 are orderly driven by the up-and-down reciprocal stroke of five conical frustum eccentric roundel 502 to move in up-and-down displacement;

Thirdly, when the conical frustum eccentric roundel 502 in the present invention moves in "up stroke" with piston acting zone 74 in up displacement, an acting force F will obliquely pull the partial portion between corresponding annular positioning protrusion 76 and outer raised brim 71 of the diaphragm membrane 70; and Finally, by means of the sloped top ring 508 in the eccentric roundel mount 500, not only the susceptible breakage of the diaphragm membrane 70 caused by the "squeezing phenomena" of high frequency is completely eliminated but also the rebounding force Fs of the diaphragm membrane 70 caused by the acting force F is tremendously reduced. Meanwhile, by means of the inverted conical frustum flank 506, the colliding possibility the conical frustum eccentric roundel 502 with the operating hole 61 in the pump head body 60 is eliminated even the outer diameter of the conical frustum eccentric roundel 502 is enlarged.

Moreover, under the same acting force F, the rebounding force Fs is inversely proportional to the contact area. By means of the enlarged outer diameter of the inverted conical frustum eccentric roundel 502, the contact area of the sloped top ring 508 with the bottom side of the diaphragm membrane 70 is increased (as ring A shown in FIG. 27) so that all distributed components of the rebounding force Fs for the inverted conical frustum eccentric roundels 502 of the present invention are further reduced.

Therefore, by means of the inverted conical frustum eccentric roundel 502 in the present invention, some benefits are obtained as below.

1. The durability of the diaphragm membrane 70 for sustaining the pumping action of high frequency from the inverted conical frustum eccentric roundel 502 is mainly enhanced.

2. The power consumption of the five-compressing-chamber diaphragm pump is tremendously diminished due to less current being wasted in the "squeezing phenomena" of high frequency.

3. The working temperature of the five-compressing-chamber diaphragm pump is tremendously subdued due to less power consumption being used.

4. The annoying noise of the bearing incurred by the aged lubricant in the compressing diaphragm pump, which is expeditiously accelerated by the high working temperature, is mostly eliminated.

5. The service lifespan of the five-compressing-chamber diaphragm pump is further prolonged because all distributed components of the rebounding force Fs for the inverted conical frustum eccentric roundels 502 of the present invention are further reduced.

Figure 30:
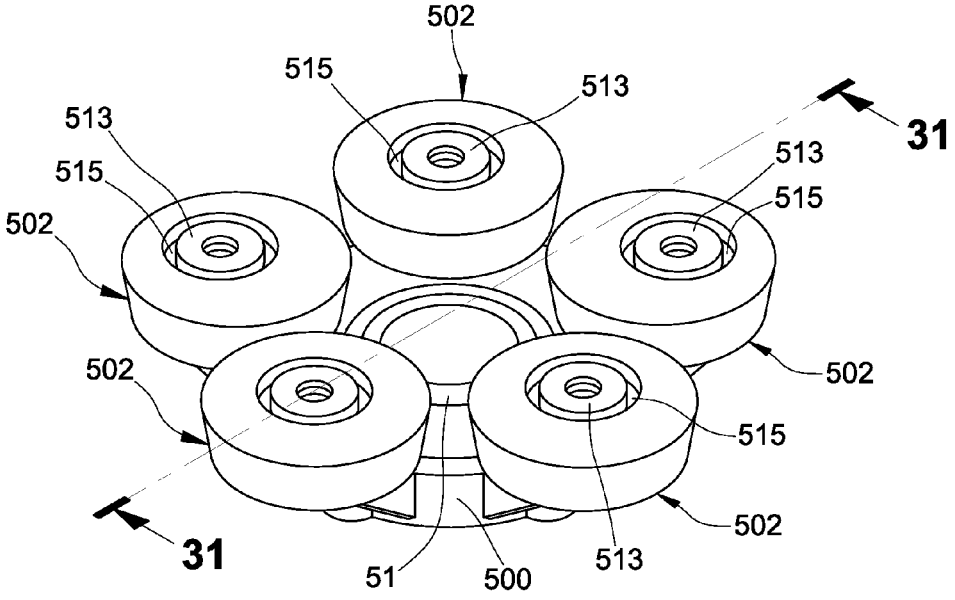
FIG. 30 is a perspective assembled view for the third exemplary embodiment of the present invention.
Figure 31:
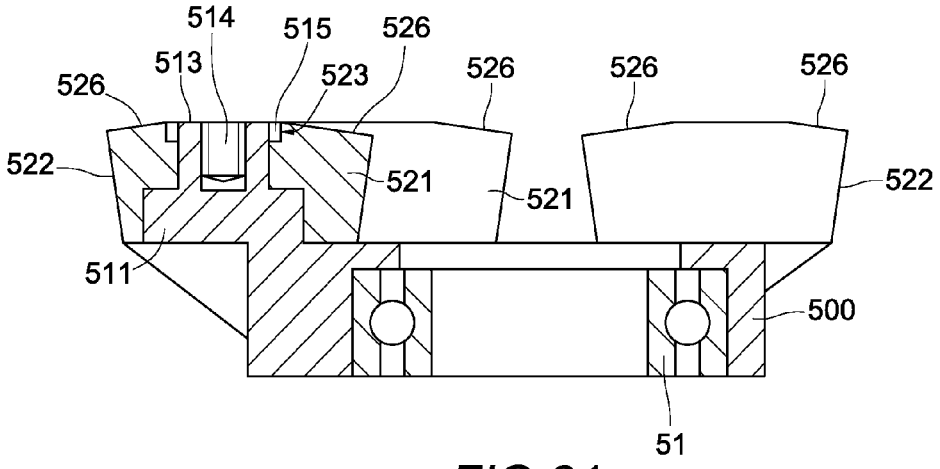
FIG. 31 is a cross sectional view taken against the section line of 31-31 from previous FIG. 30.

Please refer to FIGS. 28 through 31, which are illustrative figures of "roundel structure for five-compressing-chamber diaphragm pump" in the third exemplary embodiment of the present invention. The eccentric roundel structure is a combinational eccentric roundel 502 in an eccentric roundel mount 500. The combinational eccentric roundel 502 basically comprises a roundel mount 511 and an inverted conical frustum roundel yoke 521 in detachable separation such that the outer diameter of the conical frustum roundel yoke 521 is enlarged but still smaller than the inner diameter of the operating hole 61 in the pump head body 60, wherein said roundel mount 511, which is a two-layered frustum, includes bottom-layer base with a positional crescent 512 facing inwardly and a top-layer protruded cylinder 513 with a central female-threaded bore 514; and said inverted conical frustum roundel yoke 521, which is to sleeve over the corresponding roundel mount 511, includes an upper bore 523, a middle bore 524 and a lower bore 525 stacked as a three-layered integral hollow frustum, as well as an inverted conical frustum flank 522 and a sloped top ring 526 created from the upper bore 523 to the inverted conical frustum flank 522 such that the bore diameter of the upper bore 523 is bigger than the outer diameter of the protruded cylinder 513, the bore diameter of the middle bore 524 is equivalent to the outer diameter of the protruded cylinder 513 while the bore diameter of the lower bore 525 is equivalent to the outer diameter of the bottom-layer base in the roundel mount 511, and a positioning dented ring 515 created between the protruded cylinder 513 and the inside wall of the upper bore 523 upon having the conical frustum roundel yoke 521 sleeved over the roundel mounts 511 (as shown in FIGS. 30 and 31).

Figure 32:
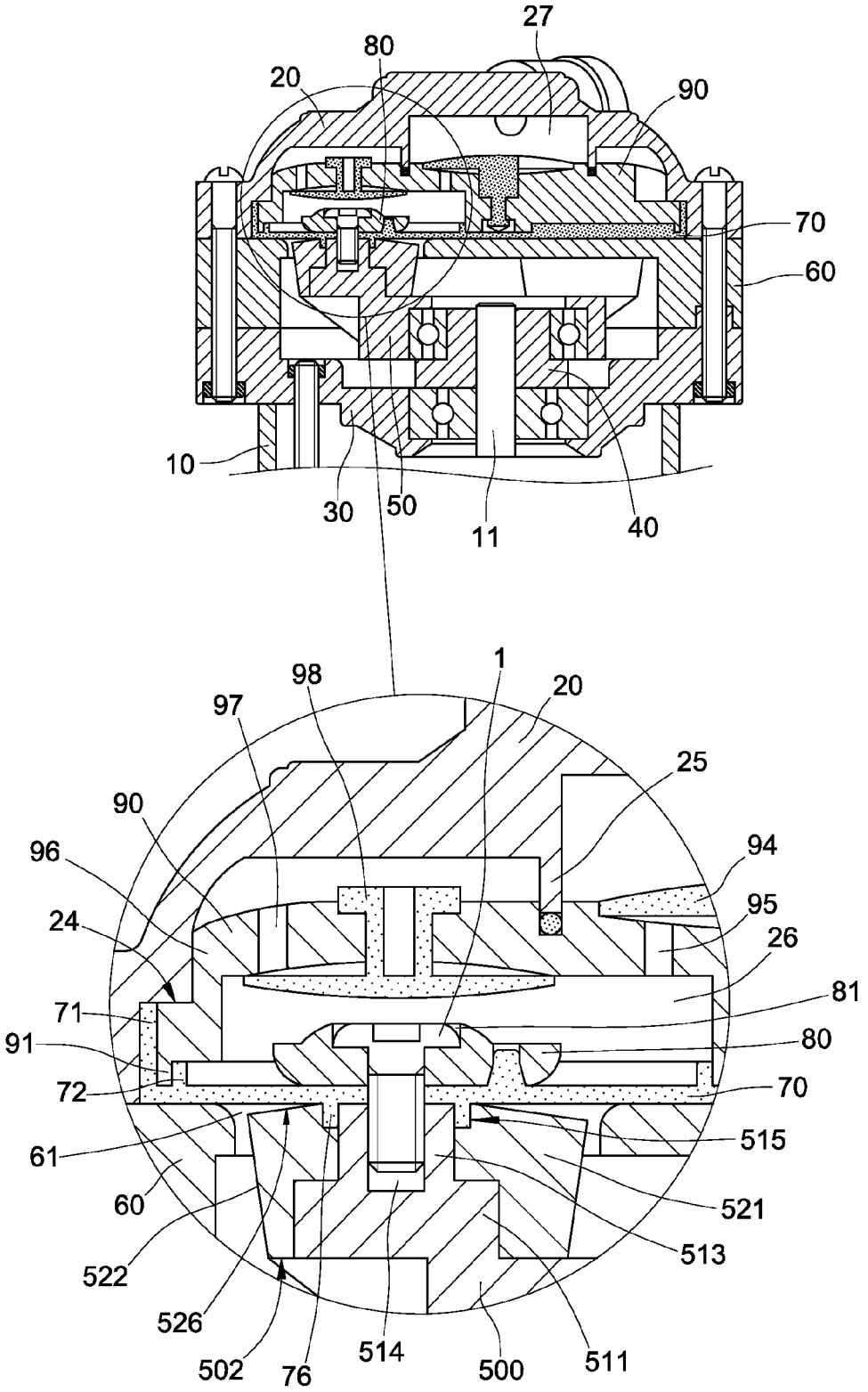
FIG. 32 is an assembled cross sectional view for the third exemplary embodiment of the present invention.
Figure 35:
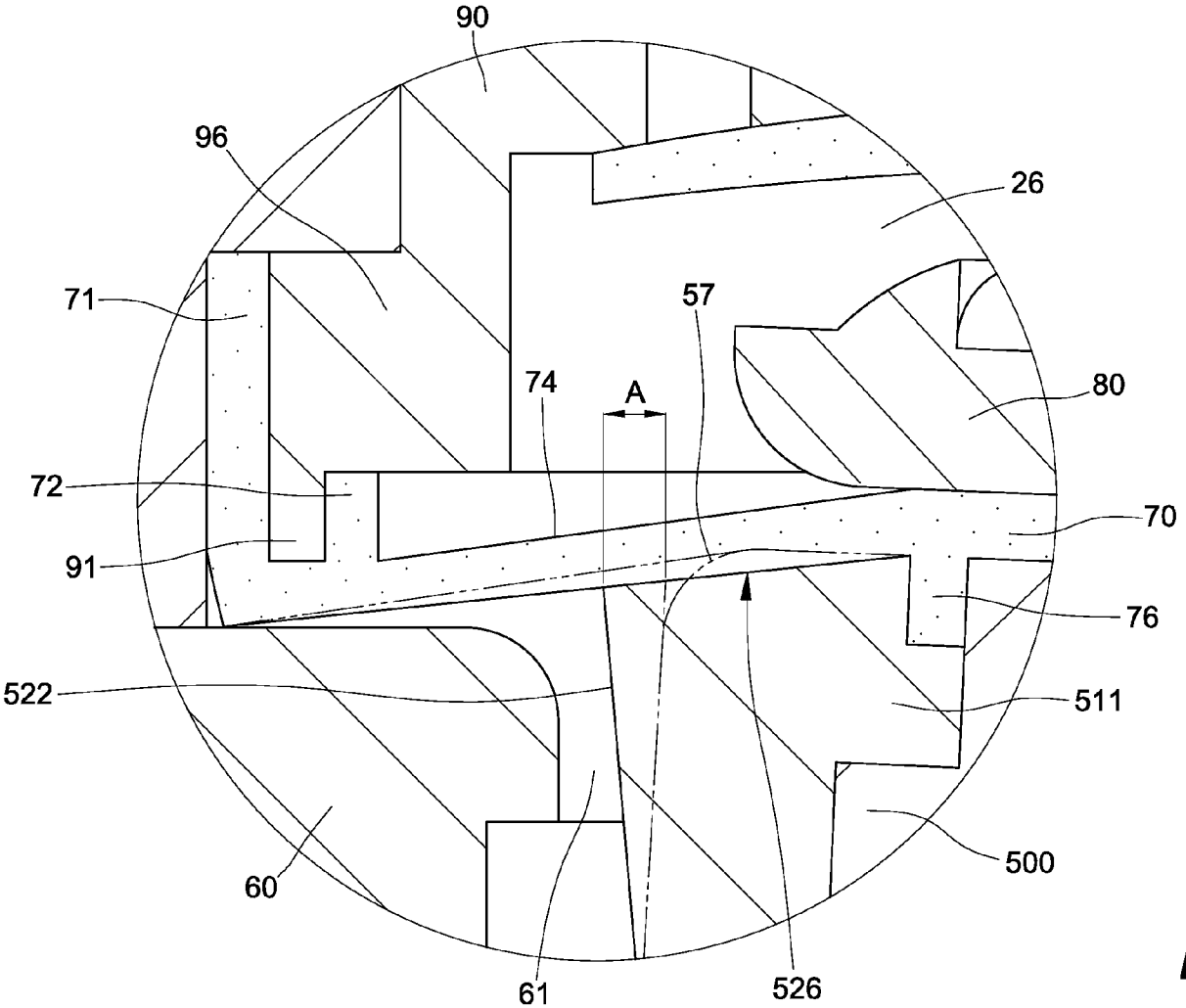
FIG. 35 is an illustrative view showing the contrastive comparison of the cylindrical eccentric roundel acting the diaphragm membrane for the conventional five-compressing-chamber diaphragm pump and the present invention in the third exemplary embodiment of the present invention.

Please refer to FIGS. 32 and 35, which are illustrative figures for the assembly of the "roundel structure for five-compressing-chamber diaphragm pump" in the third exemplary embodiment of the present invention.

Firstly, sleeve the conical frustum roundel yoke 521 over the roundel mounts 511;

Secondly, insert all five annular positioning protrusions 76 of the diaphragm membrane 70 into five corresponding positioning dented rings 515 in five combinational eccentric roundels 502 of the eccentric roundel mount 500; and Finally, by running each fastening screw 1 through the each corresponding tiered hole 81 of pumping piston 80 and each corresponding acting zone hole 75 in each piston acting zone 74 of the diaphragm membrane 70, then securely screw the fastening screw 1 to firmly assembly the diaphragm membrane 70 and five pumping pistons 80 on five corresponding female-threaded bores 514 in five roundel mounts 511 of the eccentric roundel mount 500 (as enlarged view shown in FIG. 32 of association).

Figure 33:
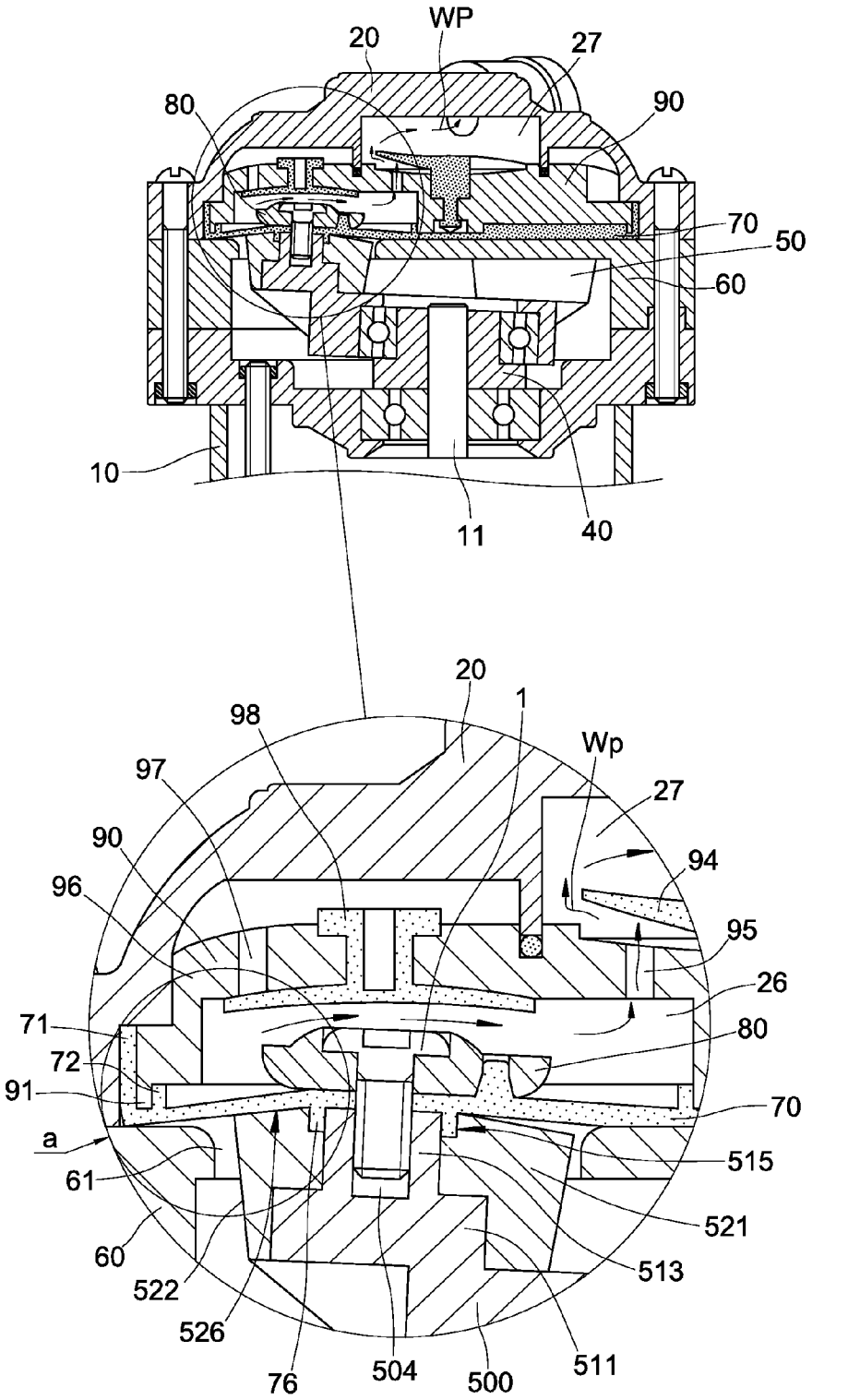
FIG. 33 is an operation illustrative view for the third exemplary embodiment of the present invention.
Figure 34:
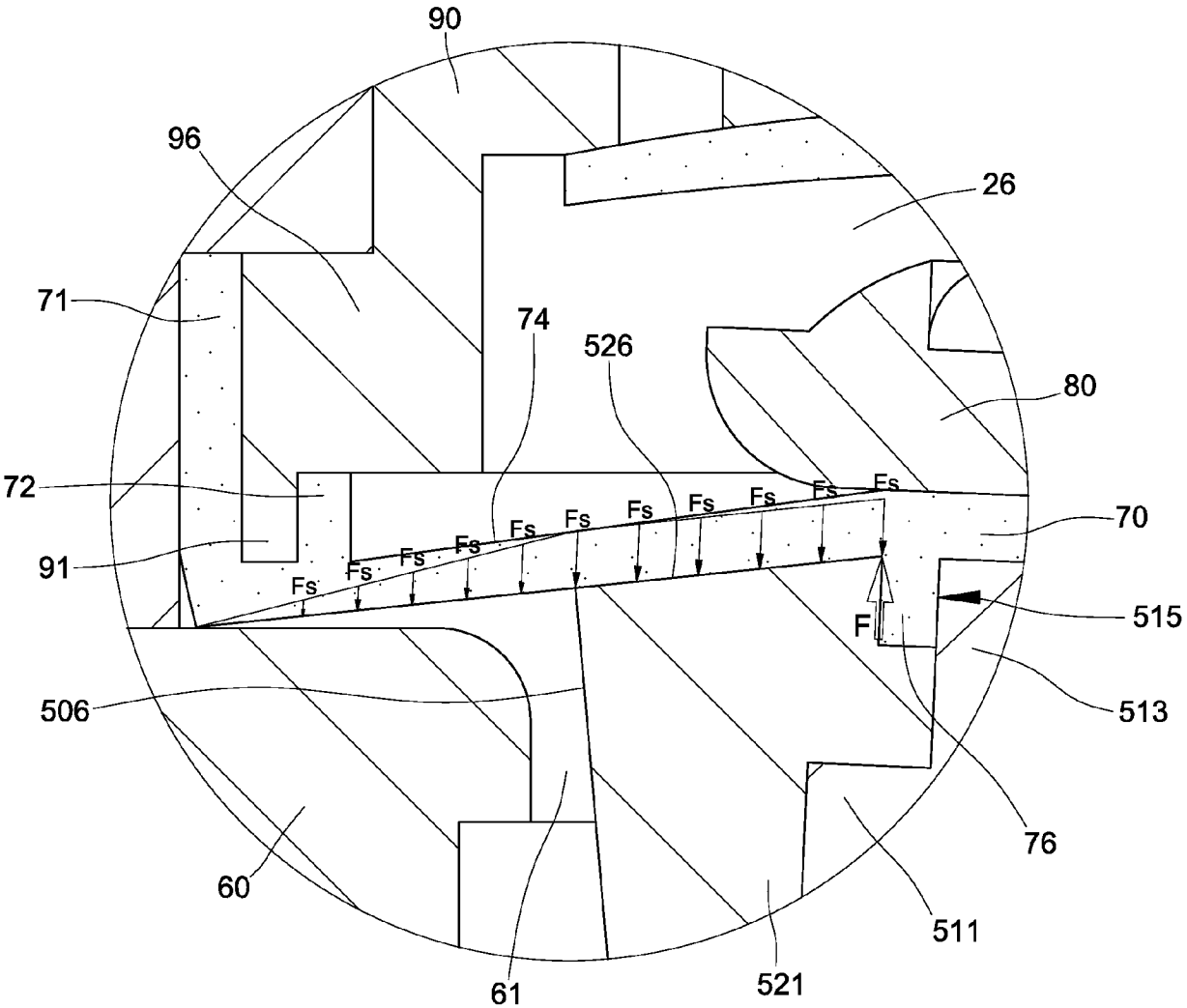
FIG. 34 is a partially enlarged view taken from circled-portion-a of previous FIG. 33.

Please refer to FIGS. 33 and 34, which are illustrative figures for the operation of the "roundel structure for five-compressing-chamber diaphragm pump" in the third exemplary embodiment of the present invention.

Firstly, when the motor 10 is powered on, the wobble plate 40 is driven to rotate by the motor output shaft 11 so that five combinational eccentric roundels 502 on the eccentric roundel mount 50 orderly move in up-and-down reciprocal stroke constantly;

Secondly, five piston acting zones 74 in the diaphragm membrane 70 are orderly driven by the up-and-down reciprocal stroke of five combinational eccentric roundels 502 to move in up-and-down displacement;

Thirdly, when the combinational eccentric roundel 502 in the present invention moves in "up stroke" with piston acting zone 74 in up displacement, an acting force F will obliquely pull the partial portion between corresponding annular positioning protrusion 76 and outer raised brim 71 of the diaphragm membrane 70; and Finally, by means of the sloped top ring 526 in the inverted conical frustum roundel yoke 521 of the eccentric roundel mount 500, not only the susceptible breakage of the diaphragm membrane 70 caused by the "squeezing phenomena" of high frequency is completely eliminated (as shown in FIGS. 33 and 34) but also the rebounding force Fs of the diaphragm membrane 70 caused by the acting force F is tremendously reduced (as enlarged view shown in FIG. 34 of association).

Moreover, under the same acting force F, the rebounding force Fs is inversely proportional to the contact area. By means of the enlarged outer diameter of the inverted conical frustum roundel yoke 521, the contact area of the sloped top ring 508 with the bottom side of the diaphragm membrane 70 is increased (as ring A shown in FIG. 35) so that all distributed components of the rebounding force Fs for the inverted conical frustum roundel yoke 521 of the present invention are further reduced.

Besides, the fabrication of the "roundel structure for five-compressing-chamber diaphragm pump" for the third exemplary embodiment in the present invention is stepwise shown as below.

Firstly, the roundel mount 511 and eccentric roundel mount 500 are fabricated together as an integral body;

Secondly, the conical frustum roundel yoke 521 is independently fabricated as a separated entity; and Finally, the conical frustum roundel yoke 521 and the integral body of roundel mount 511 with eccentric roundel mount 500 are assembled to become a united entity combinational eccentric roundel 502.

Thereby, the contrivance of the combinational eccentric roundel 502 not only meets the requirement of mass production but also reduces the overall manufacturing cost.

Therefore, by means of the combinational eccentric roundel 502 with conical frustum roundel yoke 521 in the present invention, some benefits are obtained as below.

1. The durability of the diaphragm membrane 70 for sustaining the pumping action of high frequency from the inverted conical frustum roundel yoke 521 is mainly enhanced.

2. The power consumption of the five-compressing-chamber diaphragm pump is tremendously diminished due to less current being wasted in the "squeezing phenomena" of high frequency.

3. The working temperature of the five-compressing-chamber diaphragm pump is tremendously subdued due to less power consumption being used.

4. The annoying noise of the bearing incurred by the aged lubricant in the compressing diaphragm pump, which is expeditiously accelerated by the high working temperature, is mostly eliminated.

5. The service lifespan of the five-compressing-chamber diaphragm pump is further prolonged because all distributed components of the rebounding force Fs for the inverted conical frustum roundel yoke 521 of the present invention are further reduced.

6. The manufacturing cost of the five-compressing-chamber diaphragm pump is reduced because the present invention is suitable for mass production.

In conclusion the disclosure heretofore, by means of simple new contrivance of the cylindrical eccentric roundel 52, inverted conical frustum eccentric roundel 502 and combinational eccentric roundel 502 of the present invention, the service lifespan of the diaphragm membrane 70 in the five-compressing-chamber diaphragm pump can be lengthened so that the service lifespan of the five-compressing-chamber diaphragm pump can be doubly extended. Accordingly, the present invention meets the essential criterion of the patent. Therefore, we submit the application for patent in accordance with related patent laws.

What is claimed is:

1. A roundel structure for a five-compressing-chamber diaphragm pump comprises a motor with an output shaft, a motor upper chassis, a wobble plate with an integral protruding cam-lobed shaft, an eccentric roundel mount, a pump head body, a diaphragm membrane, five pumping pistons, a piston valvular assembly and a pump head cover, wherein:

the motor upper chassis includes-an upper annular rib ring with several fastening bores disposed around a circumference of the motor upper chassis;

the wobble plate with the integral protruding cam-lobed shaft includes a shaft coupling hole through which the motor output shaft of the motor extends;

the eccentric roundel mount includes a central bearing at the bottom thereof for receiving the protruding cam-lobed shaft of the wobble plate, five inverted frustoconical eccentric roundels disposed around a circumference of the eccentric roundel mount, each frustoconical eccentric roundel having a horizontal top face, an inverted frustoconical flank, a female-threaded bore and an annular positioning groove formed on the horizontal top face;

the pump head body, which covers the upper annular rib ring of the motor upper chassis to encompass the wobble plate with the integral protruding cam-lobed shaft and the eccentric roundel mount therein, includes five operating holes disposed therein, each operating hole having an inner diameter that is bigger than an outer diameter of a respective frustoconical eccentric roundel for receiving each corresponding frustoconical eccentric roundel respectively, a lower annular flange formed under the eccentric roundel mount for mating with the upper annular rib ring of the motor upper chassis, and a plurality of fastening bores disposed around a circumference of the pump head body at locations corresponding to locations of the several fastening bores of the upper annular rib ring;

the diaphragm membrane is a semi-rigid elastic membrane placed on the pump head body, and includes an outer raised brim and an inner raised brim, each extending around a periphery of the diaphragm membrane, as well as five evenly spaced radial raised partition ribs having ends connected with the inner raised brim, five equivalent piston acting zones being formed and partitioned by the radial raised partition ribs, wherein each piston acting zone has an acting zone hole created therein in correspondence with each female-threaded bore in the frustoconical eccentric roundel of the eccentric roundel mount respectively, and an annular positioning protrusion for each acting zone hole is formed at a bottom side of the diaphragm membrane;

the pumping pistons are respectively disposed in the piston acting zones of the diaphragm membrane, and each pumping piston has a tiered hole, each annular positioning protrusion in the diaphragm membrane is inserted into a respective said annular positioning groove in the cylindrical eccentric roundel of the eccentric roundel mount, which is fastened to the diaphragm membrane by a fastening screw that extends through the tiered hole of each pumping piston and the acting zone hole of each corresponding piston acting zone in the diaphragm membrane, and that is screwed into each female-threaded bore of corresponding five cylindrical eccentric roundels in the eccentric roundel mount;

the piston valvular assembly covers the diaphragm membrane and includes a downwardly extending brim inserted between the outer raised brim and inner raised brim of the diaphragm membrane, a central dish-shaped round outlet mount having a central positioning bore with five equivalent sectors, each of which contains multiple circumferentially located outlet ports, a T-shaped plastic anti-backflow valve with a central positioning shank, and five adjacent inlet mounts, each of which includes multiple circumferentially located inlet ports and an inverted central piston disk, respectively, so that each piston disk serves as a valve for each corresponding group of multiple inlet ports, wherein the central positioning shank of the plastic anti-backflow valve mates with the central positioning bore of the central outlet mount such that multiple outlet ports in the central round outlet mount are communicable with the five adjacent inlet mounts, and a sealed preliminary-compressing chamber is formed between each inlet mount and corresponding piston acting zone in the diaphragm membrane upon insertion of the downwardly extending brim between the outer raised brim and inner raised brim of the diaphragm membrane such that one end of each preliminary-compressing chamber is communicable with each of the corresponding inlet ports;

the pump head cover, which covers the pump head body to encompass the piston valvular assembly, pumping piston and diaphragm membrane therein, includes a water inlet orifice, a water outlet orifice, and several fastening bores, and a tiered rim and an annular rib ring are disposed in a bottom inside of said pump head cover, wherein the outer brim the of diaphragm membrane is attached to the tiered rim to form a seal therewith, and wherein a high-compressing chamber is configured between a cavity formed by the inside wall of the annular rib ring and the central outlet mount of the piston valvular assembly, the bottom of the annular rib ring closely covering a brim of the central outlet mount;

a sloped top ring extends from the annular positioning groove to the inverted frustoconical flank in each frustoconical eccentric roundel of the eccentric roundel mount, wherein said inverted frustoconical eccentric roundel comprises a roundel mount and an inverted frustoconical roundel yoke in detachable separation such that the outer diameter of the frustoconical roundel yoke is enlarged but still smaller than the inner diameter of the operating hole in the pump head body, wherein said roundel mount is a two-layered frustum that includes a bottom-layer base with a positional crescent facing inwardly and a top-layer protruded cylinder with a central female-threaded bore; and said inverted frustoconical roundel yoke is sleeved over the roundel mount and includes an upper bore, a middle bore and a lower bore stacked as a three-layered integral hollow frustum, wherein the sloped top ring extends from the upper bore to the flank such that a bore diameter of the upper bore is bigger than an outer diameter of the protruded cylinder, a bore diameter of the middle bore is equal to the outer diameter of the protruded cylinder, a bore diameter of the lower bore is equal to an outer diameter of the bottom-layer base in the roundel mount, and the annular positioning groove is formed between the protruded cylinder and the inside wall of the upper bore as a result of the frustoconical roundel yoke being sleeved over the roundel mount.

2. A roundel structure for a five-compression-chamber diaphragm pump, said roundel structure including a roundel mount situated on a lower side of a pump head body and five inverted frustoconical eccentric roundels mounted on the roundel mount to extend through five operating holes in the pump head body, said five-compression-chamber diaphragm pump having a motor with a motor housing to which the pump head body is fixed, a diaphragm membrane fixed to the five inverted frustoconical eccentric roundels through the five operating holes and situated on an upper side of the pump head body, and five pumping pistons arranged to be moved in a pumping action upon movement of the diaphragm membrane, the roundel mount engaging a wobble plate such that rotation of the wobble plate by the motor causes the roundel mount to wobble, resulting in sequential up and down movement of the five inverted frustoconical eccentric roundels, the sequential up and down movement of the eccentric roundels causing sequential, reciprocating movement of five piston acting zones in the diaphragm membrane and of the five pumping pistons, and the diaphragm membrane further including five annular downwardly-projecting positioning protrusions each arranged to be inserted into a respective annular positioning groove in a top surface of each of said inverted frustoconical eccentric roundels, wherein a section of the top surface of each eccentric roundel forms a sloped top ring that extends from a respective said annular positioning groove to an inverted frustoconical flank of the respective eccentric roundel, and each of the inverted frustoconical eccentric roundels comprises a roundel mount and an inverted frustoconical roundel yoke in detachable separation such that the outer diameter of the frustoconical roundel yoke is enlarged but still smaller than the inner diameter of the operating hole in the pump head body, and wherein:

the roundel mount is a two-layered frustum that includes a bottom-layer base with a positional crescent facing inwardly and a top-layer protruded cylinder with a central female-threaded bore; and said inverted frustoconical roundel yoke is sleeved over the roundel mount and includes an upper bore, a middle bore and a lower bore stacked as a three-layered integral hollow frustum, and the sloped top ring extends from the upper bore to the inverted frustoconical flank such that a bore diameter of the upper bore is bigger than an outer diameter of the protruded cylinder, a bore diameter of the middle bore is equal to the outer diameter of the protruded cylinder, a bore diameter of the lower bore is equal to an outer diameter of the bottom-layer base in the roundel mount, and the annular positioning groove is formed between the protruded cylinder and the inside wall of the upper bore as a result of the frustoconical roundel yoke being sleeved over the roundel mount.

* * * * *